US008769740B2

(12) United States Patent
Oh

(10) Patent No.: US 8,769,740 B2
(45) Date of Patent: Jul. 8, 2014

(54) COLLAPSIBLE, FOLDING MATTRESS SUPPORT WITH ADJUSTABLE ELEVATING SHOULDER SECTION

(71) Applicant: Zinus Inc., Hayward, CA (US)

(72) Inventor: Suk Kan Oh, Xiamen (CN)

(73) Assignee: Zinus, Inc., San Leandro, CA (US)

( * ) Notice: Subject to any disclaimer, the term of this patent is extended or adjusted under 35 U.S.C. 154(b) by 0 days.

(21) Appl. No.: 13/627,493

(22) Filed: Sep. 26, 2012

(65) Prior Publication Data

US 2013/0067659 A1 Mar. 21, 2013

Related U.S. Application Data

(63) Continuation-in-part of application No. 13/526,029, filed on Jun. 18, 2012, now Pat. No. 8,370,973, which is a continuation-in-part of application No. 13/235,527, filed on Sep. 19, 2011, now Pat. No. 8,312,576.

(51) Int. Cl.
*A61G 7/00* (2006.01)

(52) U.S. Cl.
USPC ..... 5/250; 5/249; 5/174; 5/175; 5/176.1; 5/177; 5/178; 5/179; 5/180; 5/201; 5/202; 5/200.1; 5/400; 5/401; 5/310; 5/285

(58) Field of Classification Search
USPC ..... 5/249–252, 174–180, 201, 202, 200.1, 5/400, 401, 310, 285
See application file for complete search history.

(56) References Cited

U.S. PATENT DOCUMENTS

| | | | | | |
|---|---|---|---|---|---|
| 1,554,098 | A | | 9/1925 | Kaiserman | |
| 2,769,183 | A | * | 11/1956 | Froelich | 5/99.1 |
| 4,048,683 | A | * | 9/1977 | Chen | 5/180 |
| 4,654,905 | A | * | 4/1987 | Miller | 5/249 |
| 4,771,995 | A | | 9/1988 | Wells et al. | 267/103 |
| 4,903,949 | A | | 2/1990 | Schulz, Jr. | 267/103 |
| 6,076,210 | A | * | 6/2000 | Wu | 5/618 |
| 7,363,666 | B2 | * | 4/2008 | Polevoy et al. | 5/311 |
| 7,376,988 | B2 | | 5/2008 | Wickstrom et al. | 5/174 |
| 7,376,989 | B2 | | 5/2008 | Wickstrom et al. | 5/250 |
| 7,406,727 | B2 | | 8/2008 | Wickstrom et al. | 5/174 |
| 7,503,086 | B2 | | 3/2009 | Wickstrom et al. | 5/250 |
| 2010/0235989 | A1 | * | 9/2010 | Jin | 5/174 |

* cited by examiner

*Primary Examiner* — William Kelleher
(74) *Attorney, Agent, or Firm* — Imperium Patent Works; Darien K. Wallace

(57) ABSTRACT

A foldable mattress support has an adjustable inner frame with a ratchet support for raising the head of a mattress. Legs are incorporated into the side and end bars of the mattress support. Upper and lower bars of the support are pivotally attached to the vertical plate of a hinge. Bolts oriented along axes of rotation pass through the bars and through the vertical plate. A first upper bar pivots about a first axis; a second upper bar pivots about a second axis; a first lower bar pivots about a third axis; and a second lower bar pivots about a fourth axis. Each of the axes is orthogonal to the vertical plate, and the third axis is spaced farther apart from the fourth axis than the first axis is spaced apart from the second axis. The distal ends of the upper and lower bars are pivotally attached to end bars.

20 Claims, 23 Drawing Sheets

COLLAPSIBLE, FOLDING MATTRESS SUPPORT WITH ADJUSTABLE ELEVATING SHOULDER SECTION

CROSS REFERENCE TO RELATED APPLICATION

This application is a continuation-in-part of, and claims priority under 35 U.S.C. §120 from, nonprovisional U.S. patent application Ser. No. 13/526,029 entitled "Collapsible, Folding Mattress Support Having the Appearance of a Box Spring With Legs," filed on Jun. 18, 2012. Application Ser. No. 13/526,029, in turn, is a continuation-in-part of, and claims priority under 35 U.S.C. §120 from, nonprovisional U.S. patent application Ser. No. 13/235,527 entitled "A Sturdy, Collapsible, Folding Mattress Support Having the Appearance of a Box Spring," filed on Sep. 19, 2011. The subject matter of each of the foregoing documents is incorporated herein by reference.

TECHNICAL FIELD

The present invention relates to bedding products, and in particular to a collapsible, folding box spring with an adjustable, elevating shoulder section.

BACKGROUND INFORMATION

Conventional beds generally include a mattress resting on a box spring that is supported by a bed frame. Box springs are generally designed to have the outward appearance of a mattress, being covered by quilted fabric and cushioning, for example. Generally, box springs have a wooden rectangular frame supporting an array of springs to provide firm support for the mattress.

A box spring is typically constructed in one piece having the same dimensions as the mattress it supports. A conventional box spring, due to its stiff wooden frame, is often heavy and awkward to handle. The dimensions of a conventional box spring make it impractical for a consumer to transport the box spring home from a mass-market retail store. For example, the typical box spring does not fit in the trunk of a car. Moving such a box-spring into apartment elevators and around corners into bedrooms is often difficult and exposes the box springs and doorways to potential damage. In addition, the dimensions of a conventional box spring take up valuable retail floor space which discourages mass-market stores from offering box springs to their retail customers.

Attempts have been made to develop folding box springs. For example, FIG. 1 (prior art) shows a foldable bedding foundation 10 as disclosed in U.S. Pat. No. 7,376,988. Bedding foundation 10 has wire struts 11 that pivotally secure an upper wire grid 12 to wooden rails of the base 13. Wire braces 14 slide along the wire struts 11 and hold the bedding foundation 10 in an erected position when the foundation is unfolded. The two portions of the upper wire grid 12 are connected to each other by an upper hinge 15. Upper hinge 15 is a small piece of plastic that clips onto the border wires of each of the two portions of the upper wire grid 12. The two portions of the base 13 are connected to each other by a lower hinge 16, which is a piece of wire. Upper hinge 15 and lower hinge 16 are not attached to each other. The wire braces that slide along wire struts and the upper wire grids that are clipped together with a plastic hinge render bedding foundation 10 less sturdy than a conventional box spring.

A support for a mattress is sought that provides all of the support, comfort and aesthetic qualities of a conventional box spring but yet that reduces the transportation and storage space requirements of a conventional box spring. Moreover, the novel mattress support should be less flimsy than a foldable bed foundation that employs wire braces, wire struts, wire hinges and wire grids that are clipped together.

SUMMARY

A foldable mattress support includes a metal frame with a fabric covering through which legs are attached to the metal frame. The legs attach with bolts to the metal frame through slits in the fabric covering. The metal frame includes first upper and lower frames, second upper and lower frames and a hinge. Each of the upper and lower frames is pivotally attached to a vertical plate of the hinge. A bolt that is oriented along a first axis passes through the first upper frame and through the vertical plate such that the first upper frame pivots about a first axis. The second upper frame pivots about a second axis; the first lower frame pivots about a third axis; and the second lower frame pivots about a fourth axis. Each of the four axes passes through the vertical plate and is orthogonal to the vertical plate. The third axis is spaced farther apart from the fourth axis than the first axis is spaced apart from the second axis. A leg attaches through the fabric covering to a base plate on each of three middle hinges. Three legs also attach to the distal ends of each of the first and second lower frames. A headboard attachment is attached between each of the distal corners of the second lower frame and legs that screw into the corners. A headboard then attaches to the headboard attachments.

In one embodiment, a foldable mattress support is made by covering a metal frame with a fabric covering. The metal frame that is covered by the fabric covering forms a sturdy, collapsible, foldable mattress support. The metal frame includes a first section and a second section that fold together at two hinges. The first section includes a first upper frame and a first lower frame, and the second section includes a second upper frame and a second lower frame. The first upper frame remains substantially parallel to the first lower frame as the foldable mattress support is unfolded. The foldable mattress support is collapsed when the distal end of the first upper frame is moved adjacent to the distal end of the second upper frame. The first upper frame is substantially parallel to the second upper frame when the foldable mattress support is completely collapsed.

The first upper frame is pivotally attached to both of two hinges and pivots about a first axis. A bolt that is oriented along the first axis passes through the first upper frame and through a metal plate of the first hinge. The first lower frame is also pivotally attached to both of the hinges and pivots about a third axis. The second upper frame is pivotally attached to the hinges and pivots about a second axis, and the second lower frame is pivotally attached to the hinges and pivots about a fourth axis. The first, second, third and fourth axes are orthogonal to the plate of the first hinge and to a plate of the second hinge. The third axis is spaced farther apart from the fourth axis than the first axis is spaced apart from the second axis.

A flat, metal side bar is pivotally attached to both the first upper frame and the first lower frame. The side bar becomes substantially parallel to a side edge of the plate of the first hinge as the foldable mattress support is completely unfolded. The side bar provides structural support to hold up the first upper frame under the weight of a mattress resting on the foldable mattress support. A brace plate is attached to the first upper frame. Although the brace plate rotates with the first upper frame, the brace plate remains perpendicular to the plate of the first hinge. When the foldable mattress support is completely unfolded, the brace plate contacts an upper edge of the plate of the first hinge and prevents the first upper frame from rotating down past a horizontal orientation of the mattress support.

A method of manufacturing a foldable mattress support involves constructing upper and lower frames, attaching the frames to hinges, pulling a covering over the mattress support, folding the mattress support, inserting the mattress support into a packing box and inserting instructions into the packing box that instruct a user of the mattress support to unfold the folded mattress support.

Two upper frames and two lower frames are constructed by welding cross bars between U-shaped peripheral bars. Metal rods are then welded between the cross bars of each of the upper frames. The upper and lower frames are then pivotally attached to both of two hinges by bolts that are oriented along parallel axes. The upper and lower frames are attached at plates of the hinges. The first upper frame pivots about a first axis; the second upper frame pivots about a second axis; the first lower frame pivots about a third axis; and the second lower frame pivots about a fourth axis. Each of the first, second, third and fourth axes is orthogonal to the plates of the hinges. The third axis is spaced farther apart from the fourth axis than the first axis is spaced apart from the second axis. Each of the upper frames is also pivotally attached to the corresponding lower frame by two flat, metal side bars.

Elastic straps are bound from the distal corners of the upper frames to the distal corners of the lower frames. A fabric covering is then pulled over the unfolded metal frame of the mattress support, and the insertion opening in the fabric covering is closed by a zipper.

After the fabric covering is on the mattress support, the first upper frame of the mattress support is folded into the second upper frame of the mattress support. The folded mattress support is then inserted into a packing box. The inside width of the packing box is about four times the width of the bars that form the upper and lower frames plus four times the small thickness of the fabric covering. Finally, instructions are inserted into the packing box that instruct a user of the foldable mattress support how to unfold the folded mattress support.

In another embodiment, a foldable mattress support folds in three sections. The mattress support includes a first plate and a second plate that are parallel to one another. A first upper frame is pivotally attached to the first plate and pivots about a first axis, and a second upper frame is pivotally attached to the first plate and pivots about a second axis. A lower frame is pivotally attached to the first plate and pivots about a third axis. The first upper frame is also pivotally attached to the second plate and pivots about a fourth axis. A third upper frame is pivotally attached to the second plate and pivots about a fifth axis. The lower frame is also pivotally attached to the second plate and pivots about a sixth axis. Each of the first, second and third axes is orthogonal to the first plate, and each of the fourth, fifth and sixth axes is orthogonal to the second plate. The fifth axis is spaced farther apart from the fourth axis than the first axis is spaced apart from the second axis. In addition, the distance between the first and fourth axes equals the distance between the third and sixth axes.

A method for folding a three-section mattress support includes folding a first upper frame into a second upper frame and then folding a third upper frame down under the first upper frame. A covering is first pulled over the unfolded mattress support before the folding of the first upper frame into the second upper frame. The first upper frame is pivotally attached to a first plate and pivots about a first axis, whereas the second upper frame is pivotally attached to the first plate and pivots about a second axis.

The third upper frame of the mattress support is folded with respect to the first upper frame such that a distal end of the third upper frame comes closer to the first axis. The first upper frame is pivotally attached to a second plate and pivots about a forth axis, and the third upper frame is pivotally attached to the second plate and pivots about a fifth axis. A lower frame is pivotally attached to the first plate and pivots about a third axis, and the lower frame is pivotally attached to the second plate and pivots about a sixth axis. The first plate remains parallel to the second plate. Each of the first, second and third axes is orthogonal to the first plate, and each of the fourth, fifth and sixth axes is orthogonal to the second plate. The fifth axis is spaced farther apart from the fourth axis than the first axis is spaced apart from the second axis. The folded mattress support is then inserted into a packing box along with instructions that instruct a user of the mattress support to unfold the folded mattress support.

In yet another embodiment, a foldable mattress support includes a vertical plate, upper and lower bars and end bars. A first upper bar is pivotally attached to the vertical plate and pivots about a first axis; a second upper bar is pivotally attached to the vertical plate and pivots about a second axis; a first lower bar is pivotally attached to the vertical plate and pivots about a third axis; and a second lower bar is pivotally attached to the vertical plate and pivots about a fourth axis. The first upper bar has a first distal end away from the vertical plate, and the first lower bar has a second distal end away from the vertical plate. An end bar is pivotally attached to the first distal end and to the second distal end. When the mattress support is completely unfolded, the support rests on legs that are part of the end bars. Each of the first axis, the second axis, the third axis and the fourth axis is orthogonal to the vertical plate, and the third axis is spaced farther apart from the fourth axis than the first axis is spaced apart from the second axis.

A hinge that includes the vertical plate also has a bottom flange. The foldable mattress support rests on foot pads that are attached to the bottom flange. When the foldable mattress support is completely folded, mattress support rests only on the foot pads.

The mattress support also includes an adjustable inner frame that has a third upper bar. The third upper bar pivots at its inner end about a fifth axis that passes through the first upper bar. The first distal end of the first upper bar is farther from the fifth axis than the outer end of the third upper bar is from the fifth axis. A ratchet support that is pivotally attached to both the third upper bar and the first upper bar is used to elevate the adjustable inner frame.

A method of manufacturing a foldable mattress support includes bending a sheet of metal and pivotally attaching bars to a central plate of a hinge. The sheet of metal is bent to form a first angled flange, a second angled flange and the central plate. The first angled flange is bent from the central plate at a first crease, and the second angled flange is bent from the central plate at a second crease. The first crease is parallel to the second crease.

A first upper bar is pivotally attached to the central plate such that the first upper bar pivots about a first axis. A second upper bar is pivotally attached to the central plate such that the second upper bar pivots about a second axis. A first lower bar is pivotally attached to the central plate such that the first lower bar pivots about a third axis. And a second lower bar is pivotally attached to the central plate such that the second lower bar pivots about a fourth axis. Each of the first axis, the second axis, the third axis and the fourth axis is orthogonal to the central plate, and the third axis is spaced farther apart from the fourth axis than the first axis is spaced apart from the second axis. A brace is attached to the central plate and prevents the first lower bar from pivoting about the third axis past a horizontal orientation.

A third upper bar that is part of an adjustable inner frame is pivotally attached to the first upper bar. The third upper bar of the inner frame pivots about a fifth axis at the inner end of the third bar. The fifth axis is parallel to the first axis. A ratchet support is pivotally attached to both the third upper bar and the first upper bar and is used to elevate the adjustable inner frame to support the head of a mattress. The first upper bar and the second upper bar are then folded such that the first upper bar is adjacent to and substantially parallel to the second upper bar. The foldable mattress support is then inserted into a packing box.

Further details and embodiments are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Figure 2:
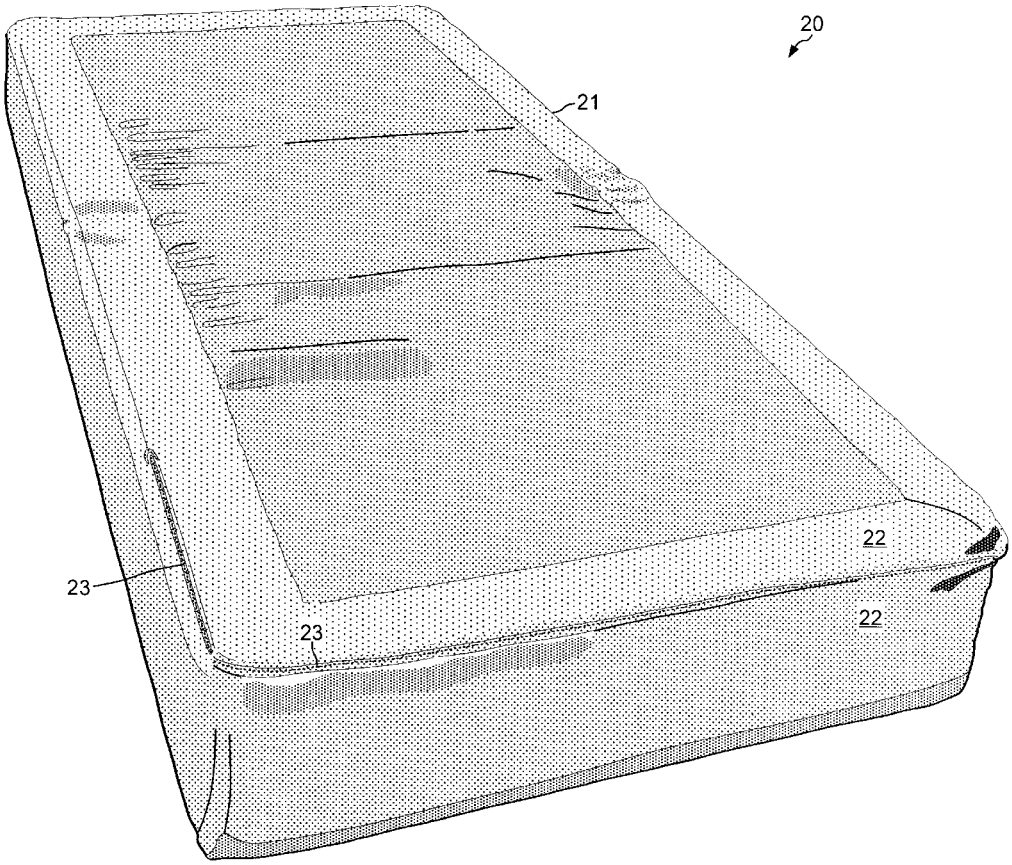
FIG. 2 is a perspective view of a sturdy, collapsible, foldable mattress support that has the appearance of a conventional box spring.

FIG. 2 shows a sturdy, collapsible, foldable mattress support 20 that has the appearance of a conventional box spring. Foldable mattress support 20 can be folded in the middle such that the upper section folds over the lower section. Thus, foldable mattress support 20 resembled a bifold box spring. Mattress support 20 has a fabric covering 21. Fabric covering 21 has a border 22 that contains cushioning quilted into the fabric. Fabric covering 21 can be opened using a zipper 23 in order to remove the covering from a metal frame beneath. Thus, fabric covering 21 can be removed, washed in a washing machine, and then placed back over the metal frame.

Figure 3:
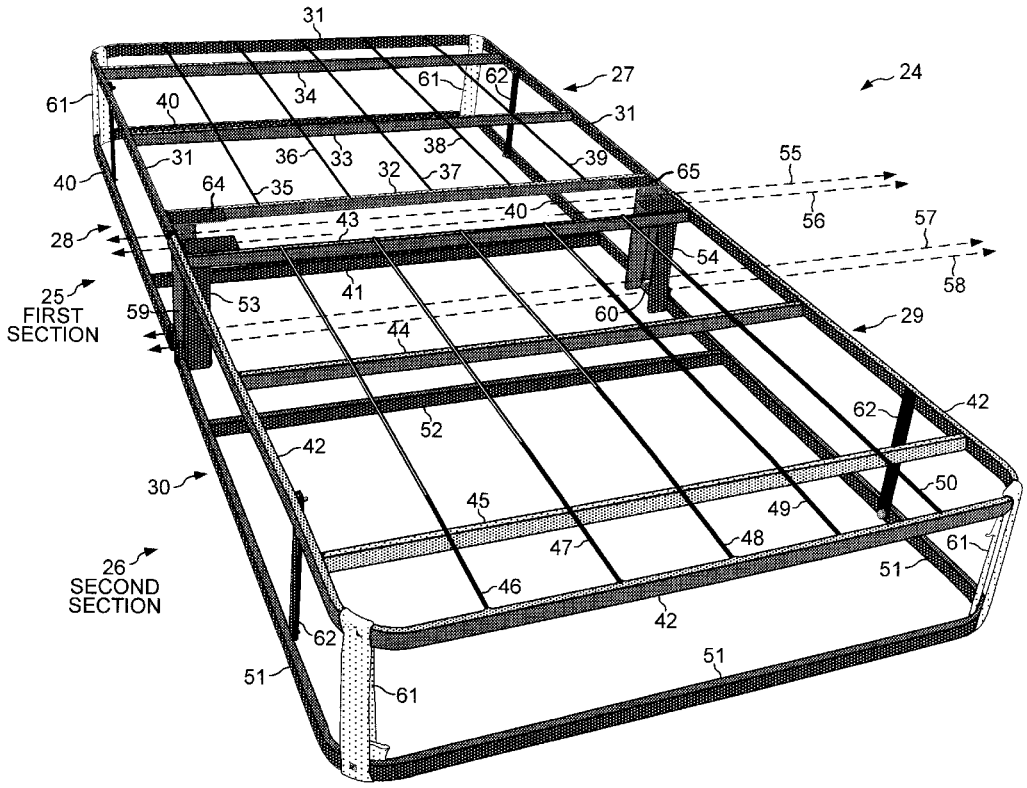
FIG. 3 is a perspective view of the metal frame of the foldable mattress support of FIG. 2 after the fabric covering has been removed.

FIG. 3 shows the metal frame 24 of foldable mattress support 20 of FIG. 2 after fabric covering 21 has been removed. Metal frame 24 is shown in FIG. 3 in a completely unfolded state. Metal frame 24 has a first section 25 and a second section 26 that have been unfolded at center hinges. First section 25 includes a first upper frame 27 and a first lower frame 28. Second section 26 includes a second upper frame 29 and a second lower frame 30. First upper frame 27 includes an upper peripheral bar 31, three upper cross bars 32-34 and metal rods 35-39. In one embodiment, upper peripheral bar 31 and the three upper cross bars 32-34 are hollow and have a rectangular cross section. The hollow, rectangular metal construction of the frames provides a stronger structure with less weight. Metal rods 35-39 are welded over the top of upper cross bars 32-34 and extend to upper peripheral bar 31. Metal rods 35-39 have a solid, circular cross section. First lower frame 28 includes a lower peripheral bar 40 and a lower cross bar 41.

Second upper frame 29 also includes an upper peripheral bar 42, three upper cross bars 43-45 and metal rods 46-50. Upper peripheral bar 42 and cross bars 43-45 also are metal and have hollow, rectangular cross sections. Second lower frame 28 includes a lower peripheral bar 51 and a lower cross bar 52.

Upper peripheral bar 31 of first upper frame 27 is pivotally attached to a first hinge 53 and to a second hinge 54 such that first upper frame 27 pivots about a first axis 55. Upper peripheral bar 42 of second upper frame 29 is pivotally attached to first hinge 53 and second hinge 54 and pivots about a second axis 56. Lower peripheral bar 40 of first lower frame 28 is pivotally attached to first hinge 53 and second hinge 54 such that first lower frame 28 pivots about a third axis 57. Lower peripheral bar 51 of second lower frame 30 is pivotally attached to first hinge 53 and second hinge 54 such that second lower frame 30 pivots about a fourth axis 58.

First hinge 53 includes a first plate 59, and each of first axis 55, the second axis 56, the third axis 57 and the fourth axis 58 is orthogonal to first plate 59. Second hinge 54 includes a second plate 60 that is oriented parallel to first plate 59. Thus, each of the axes 55-58 is also orthogonal to second plate 60.

Elastic straps 61 are bound from the distal corners of upper peripheral bar 31 to the distal corners of lower peripheral bar 40. Likewise, elastic straps 61 are bound from the distal corners of upper peripheral bar 42 to the distal corners of lower peripheral bar 51. Upper peripheral bar 31 is pivotally attached to lower peripheral bar 40 by flat metal side bars 62. The side bars 62 also pivotally attach upper peripheral bar 42 to lower peripheral bar 51. Side bars 62 provide structural support to hold up first upper frame 27 and second upper frame 29 under the weight of a mattress resting on foldable mattress support 20. Elastic straps 61 hold out fabric covering 21 at the corners of foldable mattress support 20 to maintain the appearance of a conventional box spring.

Figure 4:
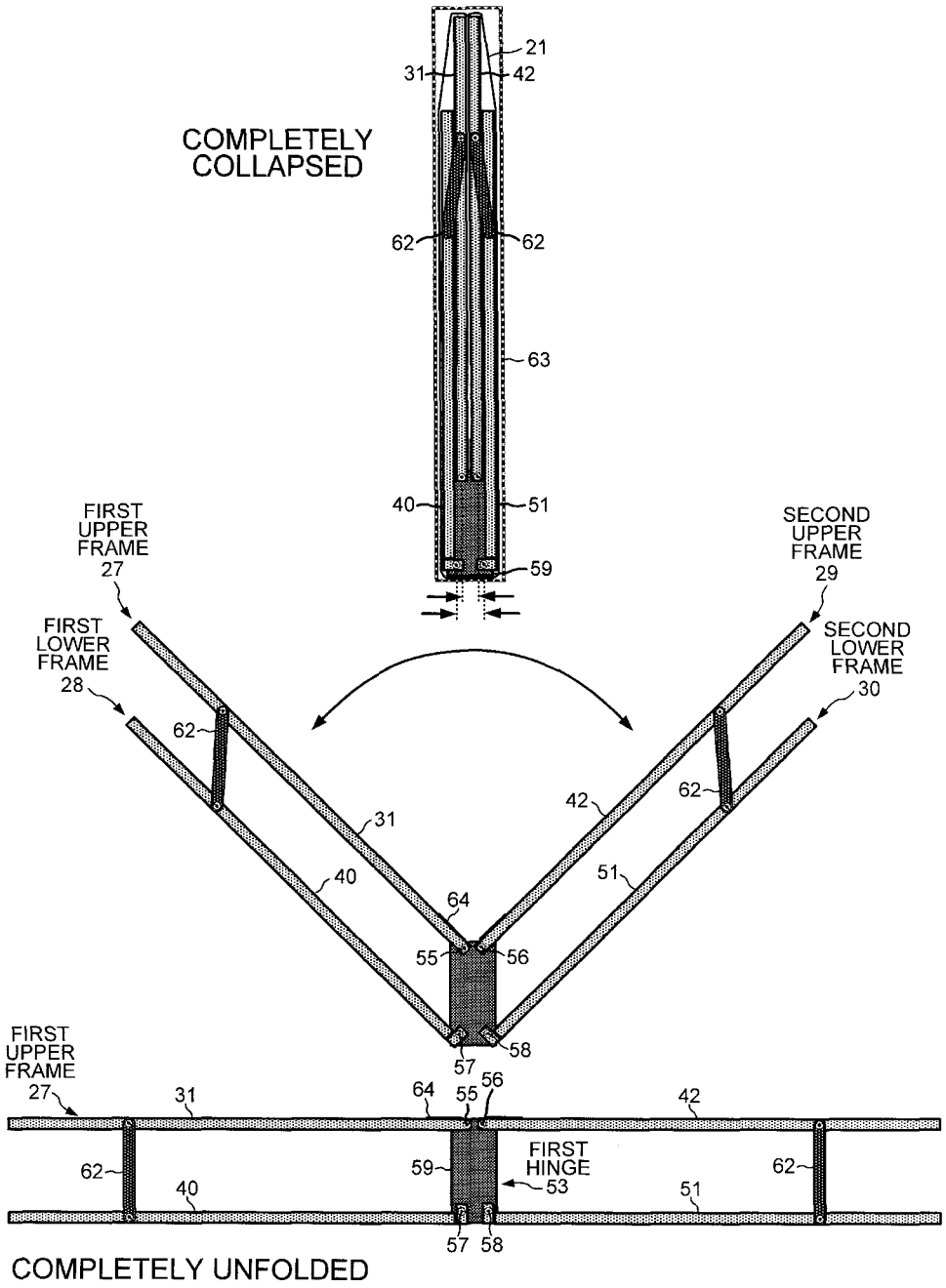
FIG. 4 is a schematic diagram of three side views of the metal frame of FIG. 3 as the mattress support is being unpacked from a packing box and unfolded.

FIG. 4 is a schematic diagram of three side views of foldable mattress support 20 as the support is being unpacked and unfolded. Although fabric covering 21 is not shown in the lower and middle views of FIG. 4, fabric covering 21 covers mattress support 20 above first upper frame 27 and second upper frame 29 and covers the mattress support below first lower frame 28 and second lower frame 30. The lower view of FIG. 4 shows mattress support 20 in a completely unfolded state. FIG. 4 shows that upper peripheral bar 31 of first upper frame 27 is pivotally attached to first hinge 53 by a bolt oriented along first axis 55. (Only axis 55 and not the bolt is labeled in FIG. 4.) FIG. 4 shows that third axis 57 is spaced farther apart from fourth axis 58 than first axis 55 is spaced apart from second axis 56. In addition, each of lower peripheral bar 40 and lower peripheral bar 51 has a short perpendicular extension through which a bolt and the axis of rotation passes. The different spacings of the axes and the perpendicular extensions allow the widths of upper peripheral bar 31 and upper peripheral bar 42 to fit between lower peripheral bar 40 and lower peripheral bar 51 when the upper and lower frames 27-30 are folded up and mattress support 20 is in a completely collapsed state, as shown in the upper view of FIG. 4. When mattress support 20 is collapsed, the distal end of first upper frame 27 is moved adjacent to the distal end of second upper frame 29. Foldable mattress support 20 is delivered in a packing box 63 in the completely collapsed state with fabric covering 21 already pulled over metal frame 24. In the collapsed state in packing box 63, first upper frame 27 is substantially parallel to second upper frame 29.

Figure 1:
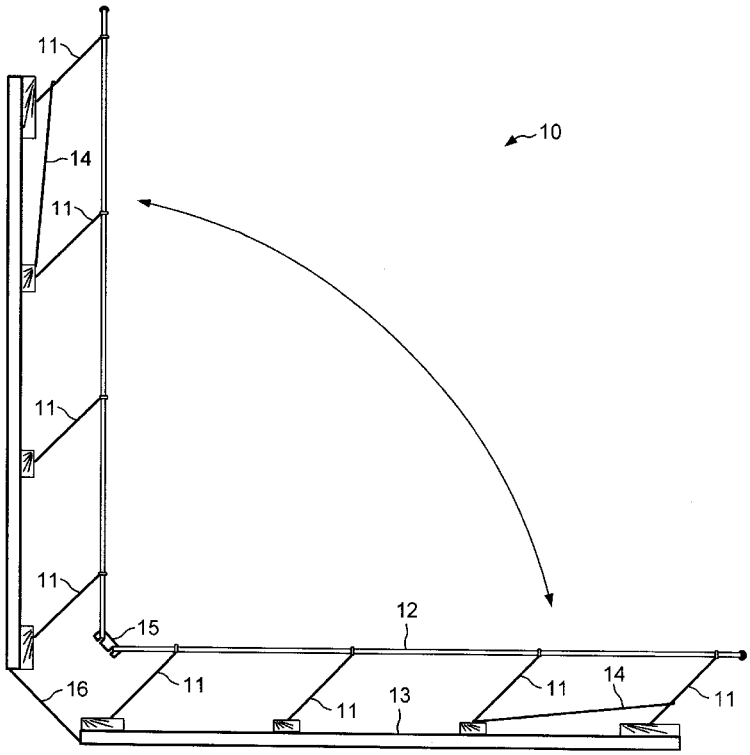
(PRIOR ART) FIG. 1
FIG. 1 (prior art) is a schematic diagram of a foldable bedding foundation that includes wire braces, wire struts, wire hinges and wire grids.

The middle view of FIG. 4 depicts metal frame 24 of foldable mattress support 20 after the support has been removed from the packing box and as the support is being unfolded. First upper frame 27 remains substantially parallel to first lower frame 28 as mattress support 20 is unfolded. The side bars 62 become substantially parallel to the side edges of plate 59 of first hinge 53 as foldable mattress support 20 is completely unfolded. Flat metal side bars 62 are stronger than the wires of the prior-art bedding foundation of FIG. 1 and allow mattress support 20 to form a sturdier base for a mattress. The side bars, peripheral bars and cross bars of mattress support 20 are less likely to squeak than are the wires of the prior-art foundation as a person lying on a mattress above the support moves.

FIG. 4 shows a brace plate 64 attached to first upper frame 27. Brace plate 64 is welded to upper peripheral bar 31 and cross bar 32 and is perpendicular to plate 59 of first hinge 53. When foldable mattress support 20 is completely unfolded as shown in the lower view of FIG. 4, brace plate 64 contacts the upper edge of first plate 59 and prevents first upper frame 27 from rotating down past a horizontal orientation in FIG. 4. A brace plate 65 serves the same function by contacting the upper edge of second plate 60 of second hinge 54. Two additional brace plates prevent second upper frame 29 from rotating down past a horizontal orientation in FIG. 4.

Figure 5:
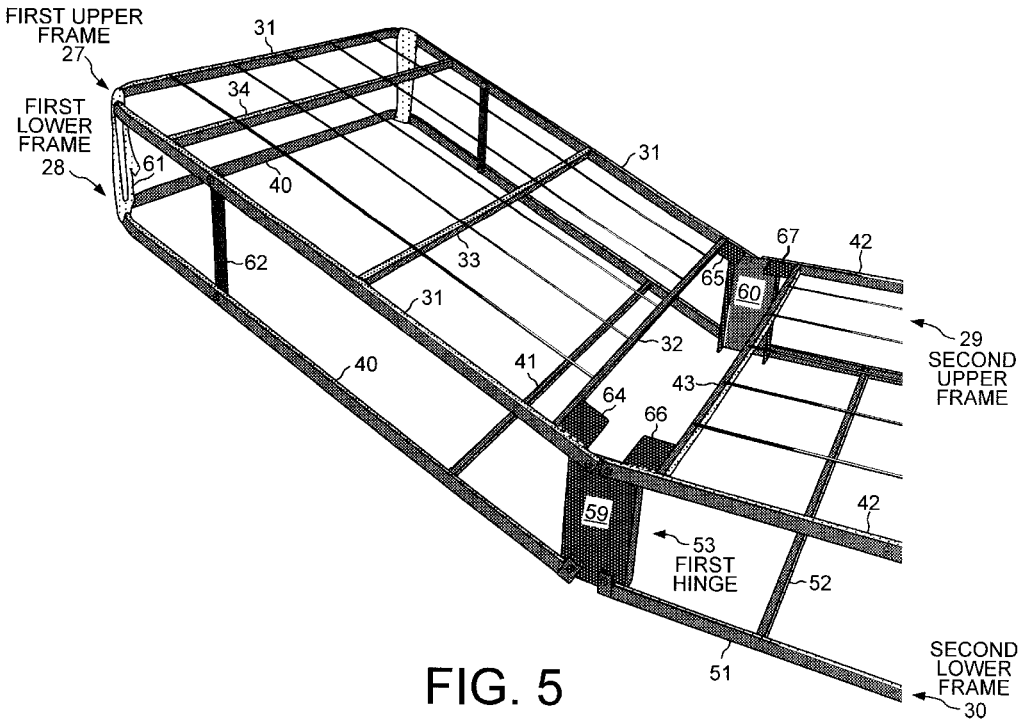
FIG. 5 is a perspective view of the metal frame of FIG. 3 with first upper and lower frames being unfolded and with second upper and lower frames already having been unfolded to a horizontal position.

FIG. 5 is a perspective view of mattress support 20 with second upper frame 29 and second lower frame 30 already unfolded and first upper frame 27 and first lower frame 28 being unfolded. FIG. 5 shows brace plates 66-67 welded to upper peripheral bar 42 and to cross bar 43. Brace plate 66 contacts the upper edge of first plate 59 and prevents second upper frame 29 from rotating down past a horizontal orientation. Likewise, brace plate 67 contacts the upper edge of second plate 60 and prevents second upper frame 29 from rotating down past a horizontal orientation. In FIG. 5, brace plates 64-65 have not yet come to rest on the upper edges of plates 59-60, respectively.

Figure 6:
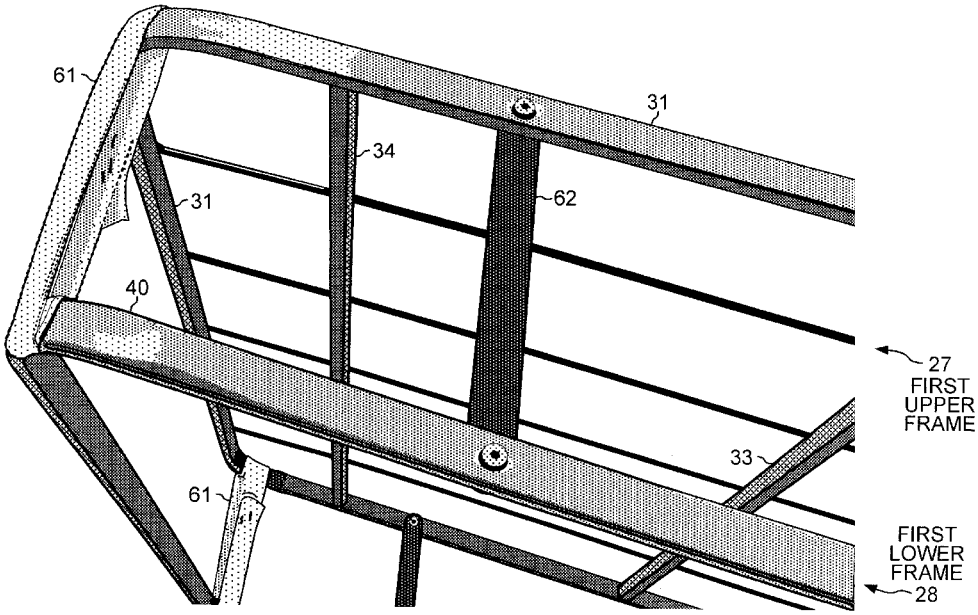
FIG. 6 is a perspective view of elastic straps connecting the corners of distal ends of upper and lower frames of one side of the metal frame of FIG. 3.

FIG. 6 shows the distal ends of first upper frame 27 and first lower frame 28. Elastic straps 61 are wrapped around the corners of upper peripheral bar 31 and lower peripheral bar 40. Each elastic strap 61 is then stapled over to itself to secure it between the peripheral bars.

Figure 7:
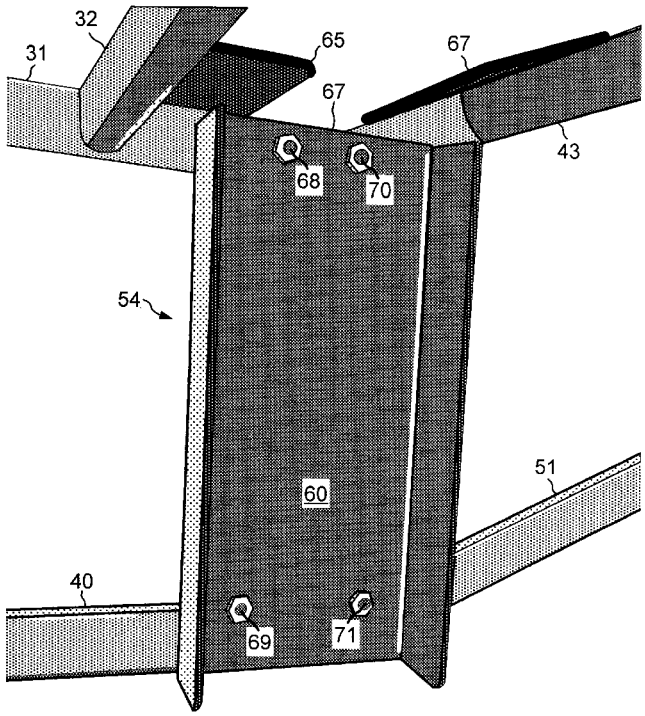
FIG. 7 is a perspective view of the inside surface of a plate of a hinge that connects the upper and lower frames of the metal frame of FIG. 3.

FIG. 7 shows the inside surface of second plate 60 of second hinge 54. Second hinge 54 is a bent piece of sheet metal that includes second plate 60 and two perpendicular wings. In FIG. 7, brace plate 65 is contacting the upper edge 67 of second plate 60 and preventing first upper frame 27 from rotating down past a horizontal orientation. Brace plate 67 has not yet come to rest on upper edge 67 because second upper frame 29 has not yet been completely unfolded. FIG. 7 also shows a bolt 68 by which first upper frame 27 is pivotally attached to second plate 60. Bolt 68 is oriented along first axis 55. In a similar fashion, bolts 69-71 pivotally attach first lower frame 28, second upper frame 29, and second lower frame 30 to second plate, respectively.

Figure 8:
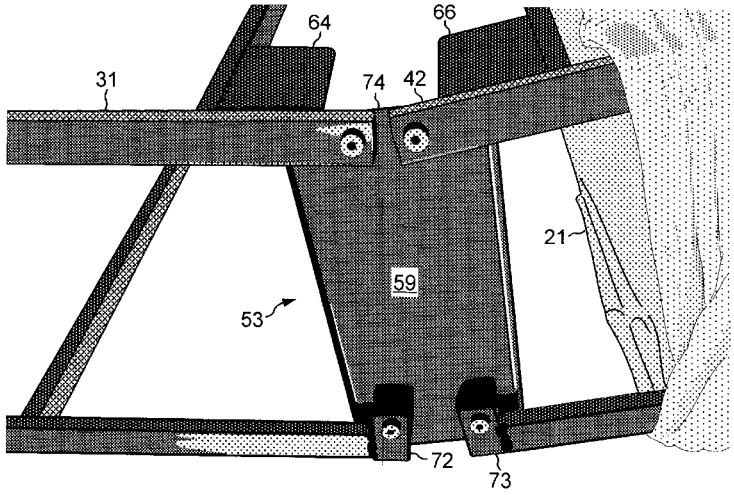
FIG. 8 is a perspective view of the outside surface of a plate of a hinge that connects the upper and lower frames of the metal frame.

FIG. 8 shows the outside surface of first plate 59 of first hinge 53. Fabric covering 21 has been pulled off of first section 25 of metal frame 24 to expose first hinge 53. Short perpendicular extensions 72-73 are welded to lower peripheral bar 40 and lower peripheral bar 51, respectively. The length of the short perpendicular extensions and the greater distance between the bolts that pass through the extensions 72-73 than between the bolts that pass through the upper peripheral bars 31 and 42 allows the widths of upper peripheral bars 31 and 42 to fit between lower peripheral bars 40 and 51 when the upper and lower frames 27-30 are folded up in the completely collapsed state. In FIG. 8, second section 26 is not yet completely unfolded, and brace plate 66 is not yet contacting the upper edge 74 of first plate 59.

Figure 9:
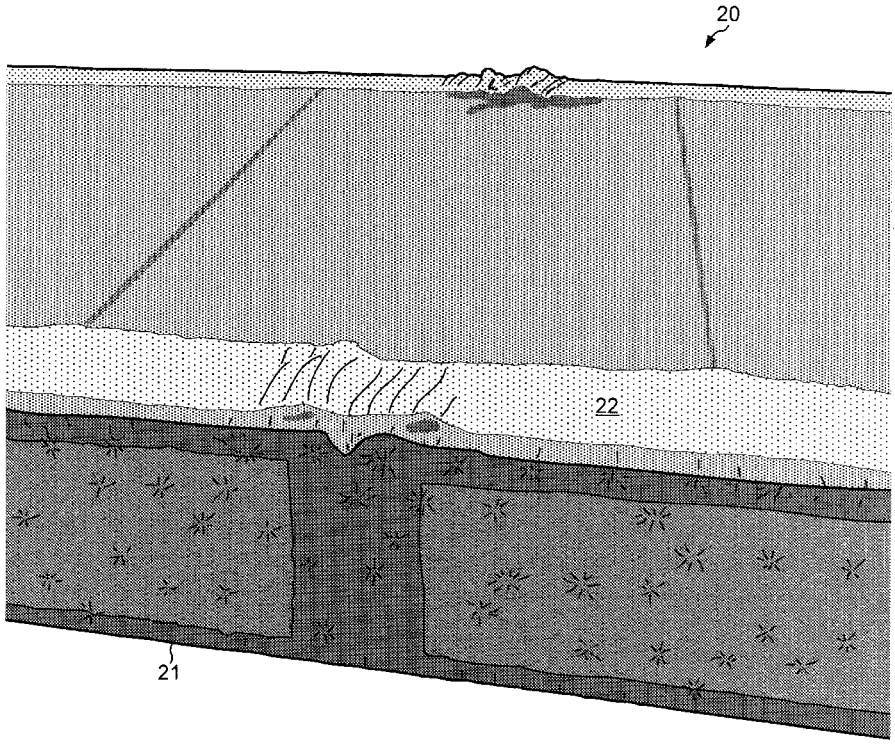
FIG. 9 is a perspective view of the fabric covering that covers the portion of the metal frame of FIG. 3 between the hinges.

FIG. 9 shows the area on fabric covering 21 that covers the portion of metal frame 24 between first hinge 53 and second hinge 54. Border 22 of fabric covering 21 that lies above the hinges 53-54 and brace plates 64-67 is reinforced so as to prevent ripping when foldable mattress support 20 is unfolded and folded. Border 22 bulges a little above the hinges 53-54 because the fabric has been wrinkled by being compressed between upper peripheral bar 31 and upper peripheral bar 42 while mattress support 20 was sitting in packing box 63.

Figure 10:
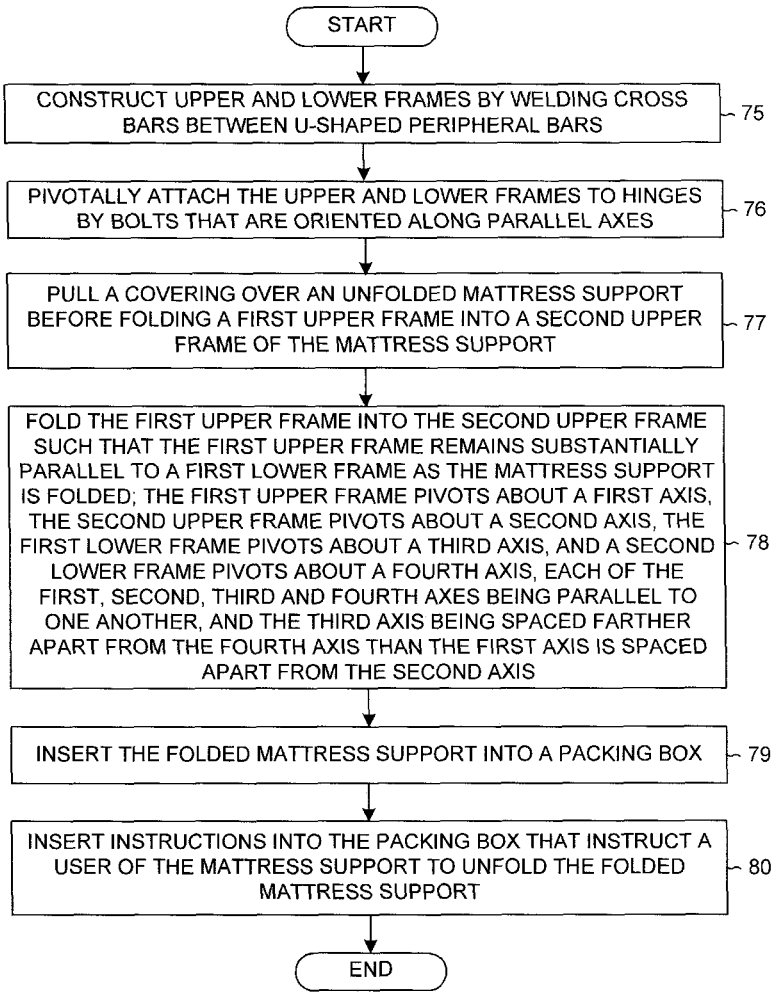
FIG. 10 is a flowchart of steps of a method of manufacturing the foldable mattress support of FIG. 2.

FIG. 10 is a flowchart illustrating steps 75-80 of a method of manufacturing foldable mattress support 20. In a first step 75, first and second upper frames 27, 29 and first and second lower frames 28, 30 are constructed by welding cross bars 32-34, 41, 43-45, 52 between U-shaped peripheral bars 31, 40, 42, 51. In one embodiment, the cross bars and peripheral bars are metal and have hollow, rectangular cross sections. Metal rods 35-39, 46-50 are then welded across the upper cross bars 32-34, 43-45 and upper peripheral bars 31, 42 of each of the first and second upper frames 27, 29.

In a step 76, the first and second upper frames 27, 29 and first and second lower frames 28, 30 are pivotally attached to first and second hinges 53-54. The first and second upper frames 27, 29 are pivotally attached to the first and second hinges 53-54 by bolts 68, 70 that are oriented along parallel first and second axes 55-56. The first and second lower frames 28, 30 are pivotally attached to the first and second hinges 53-54 by bolts 69,71 that are oriented along parallel third and fourth axes 57-58. The distance between the bolts 69, 71 that attach the first and second lower frames 28, 30 is greater than the distance between the bolts 68, 70 that attach the first and second upper frames 27, 29. The upper frames 27, 29 are attached to the lower frames 28, 30 by flat metal side bars 62. Metal frame 24 of foldable mattress support 20 is formed by pivotally attaching the upper and lower frames by the hinges 53-54 and side bars 62.

In step 77, fabric covering 21 is pulled over unfolded metal frame 24. An opening in fabric covering through which metal frame 24 passes is closed using a zipper.

In step 78, first upper frame 27 is folded up into second upper frame 29 such that first upper frame 27 remains substantially parallel to first lower frame 28 as mattress support 20 is folded. Second upper frame 29 also remains substantially parallel to second lower frame 30 as mattress support 20 is folded, as illustrated in the middle view of FIG. 4.

In step 79, the folded mattress support 20 inside fabric covering 21 is inserted into a cardboard packing box 63. The inside width of the packing box can be as small as about four times the width of a peripheral bar plus four times the small thickness of fabric covering 21. Bolts 68 and 70 are spaced far enough apart to allow room for fabric covering 21 to fit between upper frames 27, 29 when foldable mattress support 20 is completely collapsed.

In step 80, instructions are inserted into packing box 63 that instruct a user of foldable mattress support 20 to unfold the folded mattress support after removing it from the packing box.

By manufacturing the mattress support 20 so that it can fold in half and collapse flat, the mattress support is better suited to sell in mass-market retail stores and can more easily be transported from the store to the location of the mattress to be supported. The large dimensions of a conventional box spring take up valuable floor space in mass-market stores. Less floor space is needed to store and display foldable mattress support 20 on store shelves. The large size and unitary construction of a conventional box spring also make it impractical for a consumer to transport the box spring home from a mass-market retail store. The small packing box 63 containing the collapsed mattress support 20, however, can easily be brought from the store shelf to the check-out counter and then to the trunk of the consumer's car. In addition, the damage that occurs when conventional one-piece wooden box springs are moved through doorways can be avoided. The packing box 63 containing foldable mattress support 20 can more easily be maneuvered up stairs, into apartment elevators and around corners than would a conventional non-collapsible box spring.

Figure 11A:
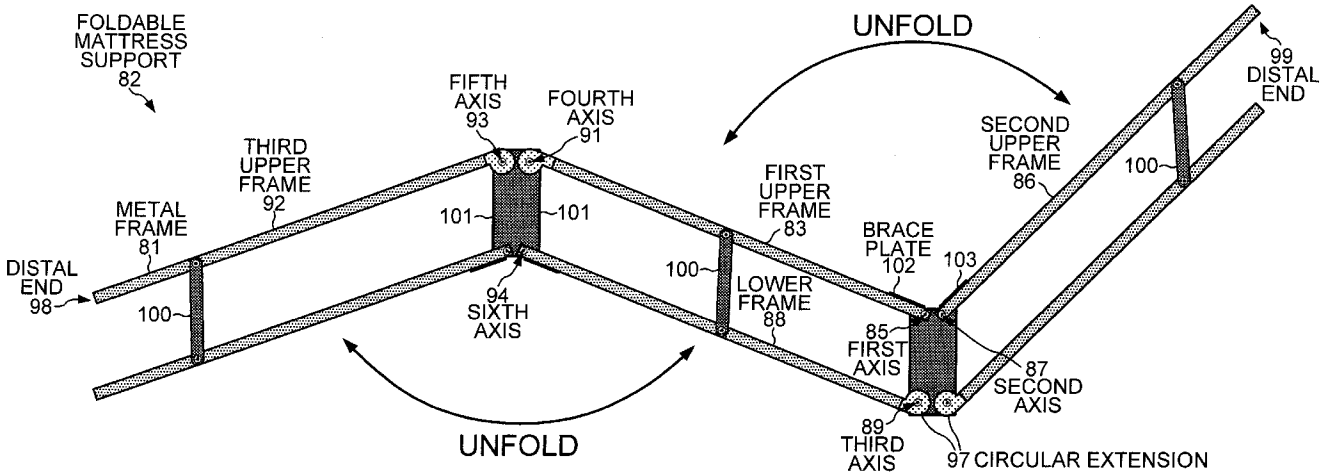
FIGS. 11A-B are schematic diagrams of side views of a metal frame of a three-section mattress support being unfolded.
Figure 11B:
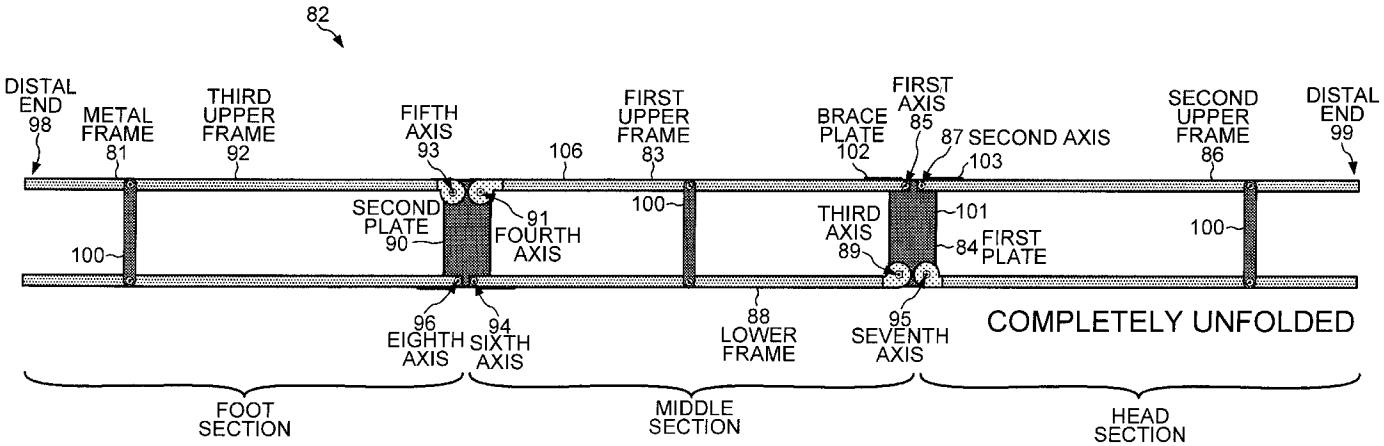

FIGS. 11A-B are schematic diagrams of the metal frame 81 of another embodiment of a foldable mattress support 82 that can be folded in the three sections. Thus, foldable mattress support 82 resembled a trifold box spring. The fabric covering has been removed from metal frame 81 of mattress support 82 in FIG. 11. FIG. 11A shows a side view of foldable mattress support 28 as the support is being unfolded. FIG. 11B is a side view of the mattress support 28 in a completely unfolded state. Metal frame 81 has two hinges on each side. Each hinge includes a planar plate of metal. The two plates on the left side of metal frame 81 are visible in the side views of FIG. 11.

FIG. 11 shows that a first upper frame 83 is pivotally attached to a first plate 84 by a bolt oriented along a first axis 85. (Only axis 85 and not the bolt is labeled in FIG. 11.) First upper frame 83 pivots about first axis 85, which passes through first plate 84. A second upper 86 frame is pivotally attached to first plate 84 and pivots about a second axis 87, which also passes through first plate 84. A lower frame 88 is pivotally attached to first plate 84 and pivots about a third axis 89, which also passes through first plate 84. First upper frame 83 and lower frame 88 are part of a middle section of metal frame 81, and second upper frame 86 is part of a foot section of metal frame 81.

A planar second plate 90 is oriented parallel to planar first plate 84. First upper frame 83 is also pivotally attached to second plate 90 and pivots about a fourth axis 91 that passes through second plate 90. A third upper frame 92 is pivotally attached to second plate 90 and pivots about a fifth axis 93 that passes through second plate 90. Lower frame 88 is pivotally attached to second plate 90 and pivots about a sixth axis 94, which also passes through second plate 90. Third upper frame 92 is part of a head section of metal frame 81. A seventh axis 95 also passes through first plate 84, and an eighth axis 96 also passes through second plate 90. All of the first through eighth axes are orthogonal to the parallel first and second plates 84 and 90.

FIG. 11 shows that third axis 89 is spaced farther apart from seventh axis 95 than first axis 85 is spaced apart from second axis 87. In addition, each of lower frame 88 and the lower frame of the head section has an offset circular extension 97 through which a bolt and the axis of rotation passes. The different spacings of the axes and the circular extensions allow the widths of first upper frame 84 and second upper frame 86 to fit between lower frame 88 and the lower frame of the foot section when the frames are folded up and mattress support 82 is in a completely folded state.

The spacing of the axes through second plate 90 is inverted compared to the spacing of the axes through first plate 84. Thus, the bottom axes 89 and 95 through first plate 84 are spaced farther apart that the top axes 85 and 87, whereas the top axes 91 and 93 through second plate 90 are spaced farther apart that the bottom axes 94 and 96. The inverted spacing of the axes through first plate 84 compared to second plate 90 permits mattress support 82 to be folded in a zigzag manner that occupies the least amount of space when completely folded together. The inverted spacing of the axes also results in the fifth axis 93 being spaced farther apart from fourth axis 91 than first axis 85 is spaced apart from second axis 87. For the same reason, the distance between first axis 85 and fourth axis 91 equals the distance between third axis 89 and sixth axis 94.

As mattress support 82 is folded together, the distal end 98 of the third upper frame comes closer to first axis 85. When mattress support 82 is folded together, the distal end 99 of second upper frame 86 is moved close to fourth axis 91 such that first upper frame 83 and second upper frame 86 are adjacent to one another. Foldable mattress support 82 is delivered in a packing box in the completely folded state with a fabric covering already pulled over metal frame 81. In the folded state in the packing box, first upper frame 83 is substantially parallel to second upper frame 86.

FIG. 11A depicts metal frame 81 of foldable mattress support 82 after the support has been removed from the packing box and as the support is being unfolded. First upper frame 83 remains substantially parallel to lower frame 88 as mattress support 82 is unfolded. The side bars 100 become substantially parallel to the side edges 101 of first plate 84 and second plate 90 as foldable mattress support 82 is completely unfolded. A brace plate 102 attached to first upper frame 83 near first plate 84. Brace plate 102 is welded to the bars that form first upper frame 83 and is perpendicular to first plate 84. When foldable mattress support 82 is completely unfolded as shown in FIG. 11B, brace plate 102 contacts the upper edge of first plate 84 and prevents first upper frame 83 from rotating down past a horizontal orientation in FIG. 11B. A brace plate 103 serves the same function for second upper frame 86 by also contacting the upper edge of first plate 84 when metal frame 81 is completely unfolded. Metal frame 81 also has two additional brace plates 104 and 105 that contact the upper edge of a mirror-image plate on the right side of metal frame 81 opposite first plate 84 when the frame is completely unfolded. The four brace plates 102-105 prevent first upper frame 83 and second upper frame 86 from rotating down past a horizontal orientation in FIG. 11B.

Figure 12:
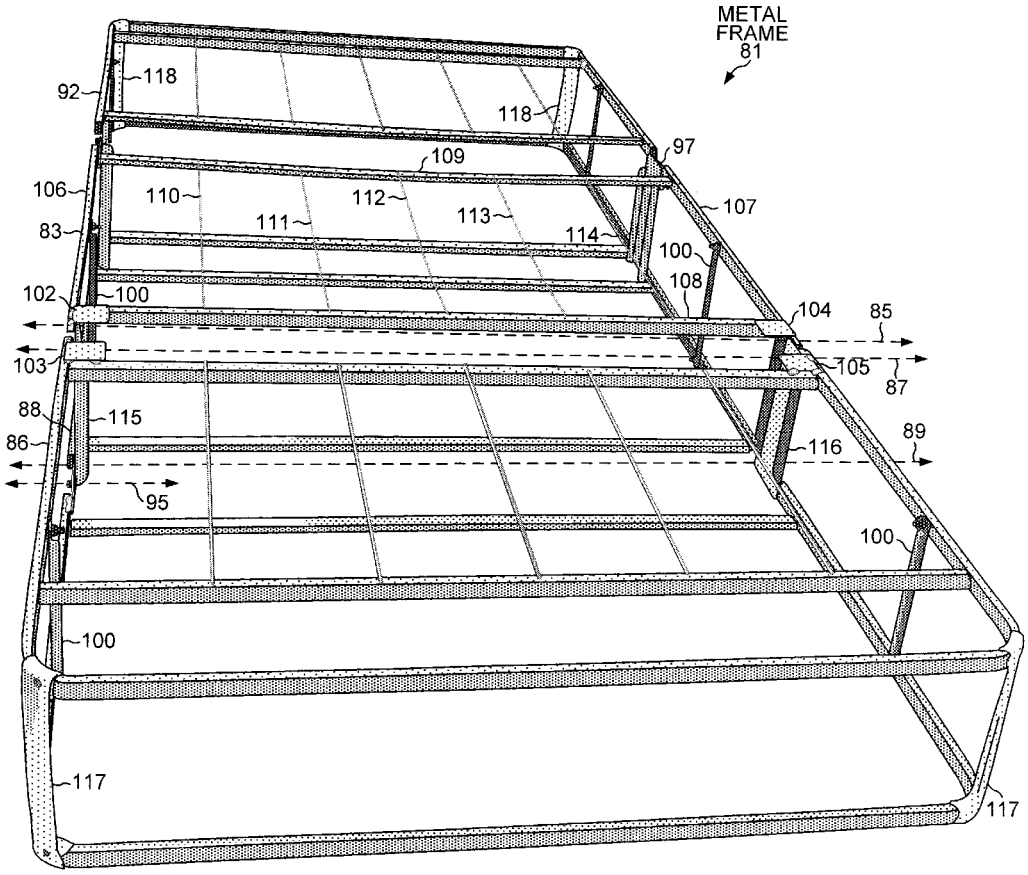
FIG. 12 is a perspective view of a metal frame of a three-section foldable mattress support after the fabric covering has been removed.

FIG. 12 is a perspective view of metal frame 81 of foldable mattress support 82 after the fabric covering has been removed. Metal frame 81 is shown in FIG. 12 in a completely unfolded state. First upper frame 83 includes a left upper bar 106, a right upper bar 107, a first cross bar 108, a second cross bar 109 and five metal rods 110-114. FIG. 12 shows a circular extension welded to the end of right upper bar 107. In one embodiment, upper bars 106-107 and cross bars 108-109 are hollow and have a rectangular cross section. The hollow, rectangular metal construction of the frames provides a stronger structure with less weight. Metal rods 110-114 are welded over the top of cross bars 108-109 and have a solid, circular cross section. Lower frame 88 similarly includes left and right lower bars and two cross bars.

FIG. 12 shows that left upper bar 106 is pivotally attached to first plate 84 below brace plate 102 and is adapted to rotate about first axis 85. Each of first axis 85, second axis 87, third axis 89 and seventh axis 95 is orthogonal to first plate 84. A reinforcing flange 115 is attached to a side of first plate 84 and is perpendicular to the plane of first plate 84. In the view of FIG. 12, first plate 84 is hidden behind reinforcing flange 115. Another reinforcing flange 116 is shown attached to a side of the mirror-image plate on the right side of metal frame 81 opposite first plate 84. At the head end of foldable mattress support 82, elastic straps 117 are bound from the distal corners of second upper frame 86 to the corners of the lower frame below. Similarly at the foot end of foldable mattress support 82, elastic straps 118 are bound from the distal corners of third upper frame 92 to the corners of the lower frame below. First upper frame 83 is pivotally attached to lower frame 88 by side bars 100 that have a reinforcing flange. In addition, the side bars 100 provide structural support to hold up second upper frame 86 and third upper frame 92 under the weight of a mattress resting on foldable mattress support 82. The elastic straps 117-118 hold out the fabric covering at the corners of foldable mattress support 82 to maintain the appearance of a conventional box spring.

By manufacturing the mattress support 82 so that it can fold in three sections and collapse flat, the mattress support can be packaged in an even smaller box whose dimensions are more likely to fit in the trunk of a car. Thus, trifold mattress support 82 is even better suited for sale in mass-market retail stores. The more compact packing box containing the collapsed mattress support 82 can more easily be brought from the store shelf to the check-out counter and then to the trunk of the consumer's car.

The manufacturer of mattress support 82 pulls a fabric covering over unfolded metal frame 81 at the factory. An opening in the fabric covering through which metal frame 81 passes is closed using a zipper. First upper frame 83 is then folded into second upper frame 86, and third upper frame 92 is folded with respect to first upper frame 83 such that distal end 98 of third upper frame 92 comes closer to first axis 85. Thus, the head section is folded into the middle section, and the foot section is folded under the middle section. First upper frame 83 remains substantially parallel to lower frame 88 as mattress support 82 is folded.

The manufacturer then inserts the folded mattress support 82 (covered by the fabric covering) into a cardboard packing box 63. The inside width of the packing box can be as small as about six times the width of the bars plus six times the small thickness of the fabric covering. First and second axes 85 and 87 are spaced far enough apart to allow room for the fabric covering to fit between the first and second upper frames 83 and 86 when foldable mattress support 82 is completely collapsed. Likewise, sixth and eighth axes 94 and 96 are spaced far enough apart to allow room for the fabric covering to fit between the lower bars when foldable mattress support 82 is completely collapsed. Finally, the manufacturer inserts instructions into the packing box that instruct a user of foldable mattress support 82 to unfold the folded mattress support after removing it from the packing box.

In another embodiment, legs are attached to a foldable mattress support obviating the need to place the mattress support on a bed frame. Foldable mattress support 20 and foldable mattress support 82 both have the appearance of a conventional box spring and can be used as a box spring by placing them on a conventional bed frame of L-shaped side rails (also called angle iron). However, the metal tube construction of the foldable mattress supports is sufficiently sturdy to enable the support to be placed on its own legs without any additional reinforcing.

Figure 13:
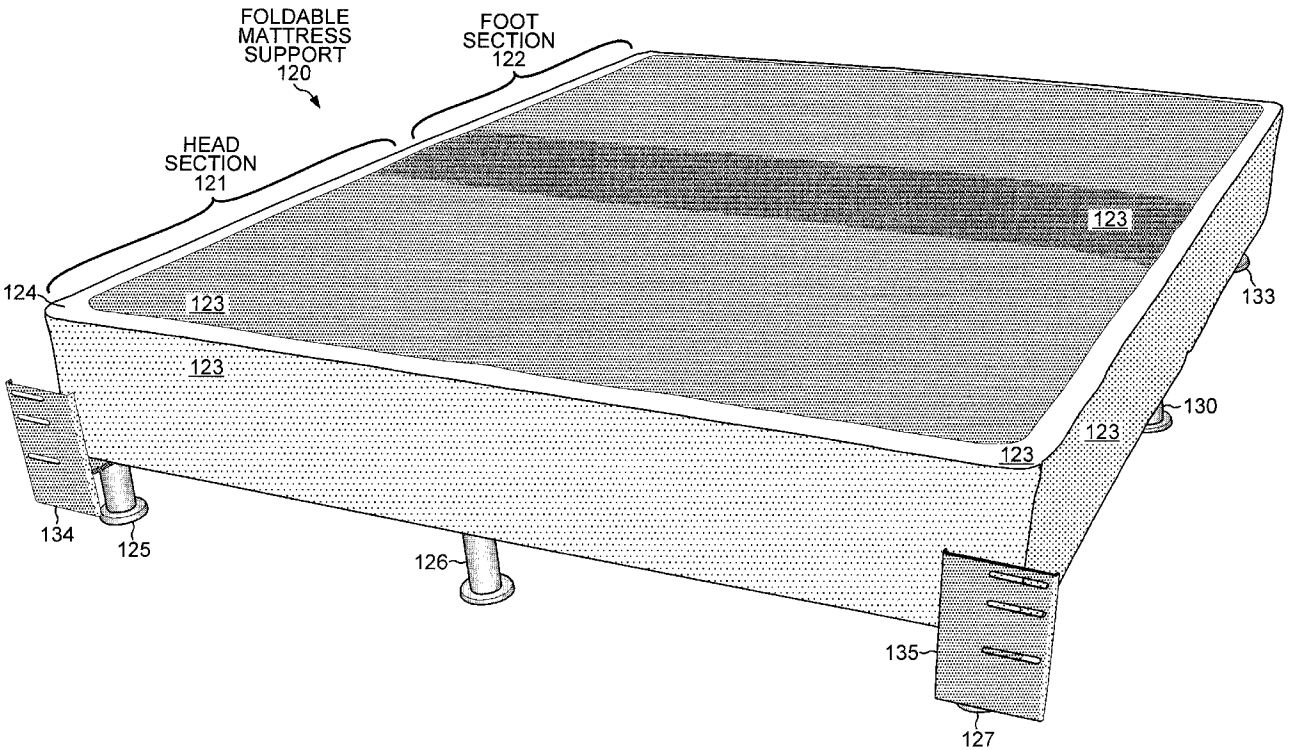
FIG. 13 is a perspective view of a foldable mattress support having the appearance of a box spring with legs.

FIG. 13 shows a sturdy, collapsible, foldable mattress support 120 that has the appearance of a box spring sitting on legs. Foldable mattress support 120 is a bifold box spring that can be folded in the middle such that a head section 121 folds over a foot section 122. Mattress support 120 has a fabric covering 123. Fabric covering 123 has a border 124 that contains cushioning quilted into the fabric. Mattress support 120 sits on nine legs 125-133 that attach to the metal frame within fabric covering 123. Only five of the nine legs are visible in the view of FIG. 13. Two headboard attachments 134-135 attach to mattress support 120 between the metal frame and legs 125 and 127. A headboard is attached to mattress support 20 by slipping tongues of the headboard into slots in the headboard attachments 134-135.

Figure 14:
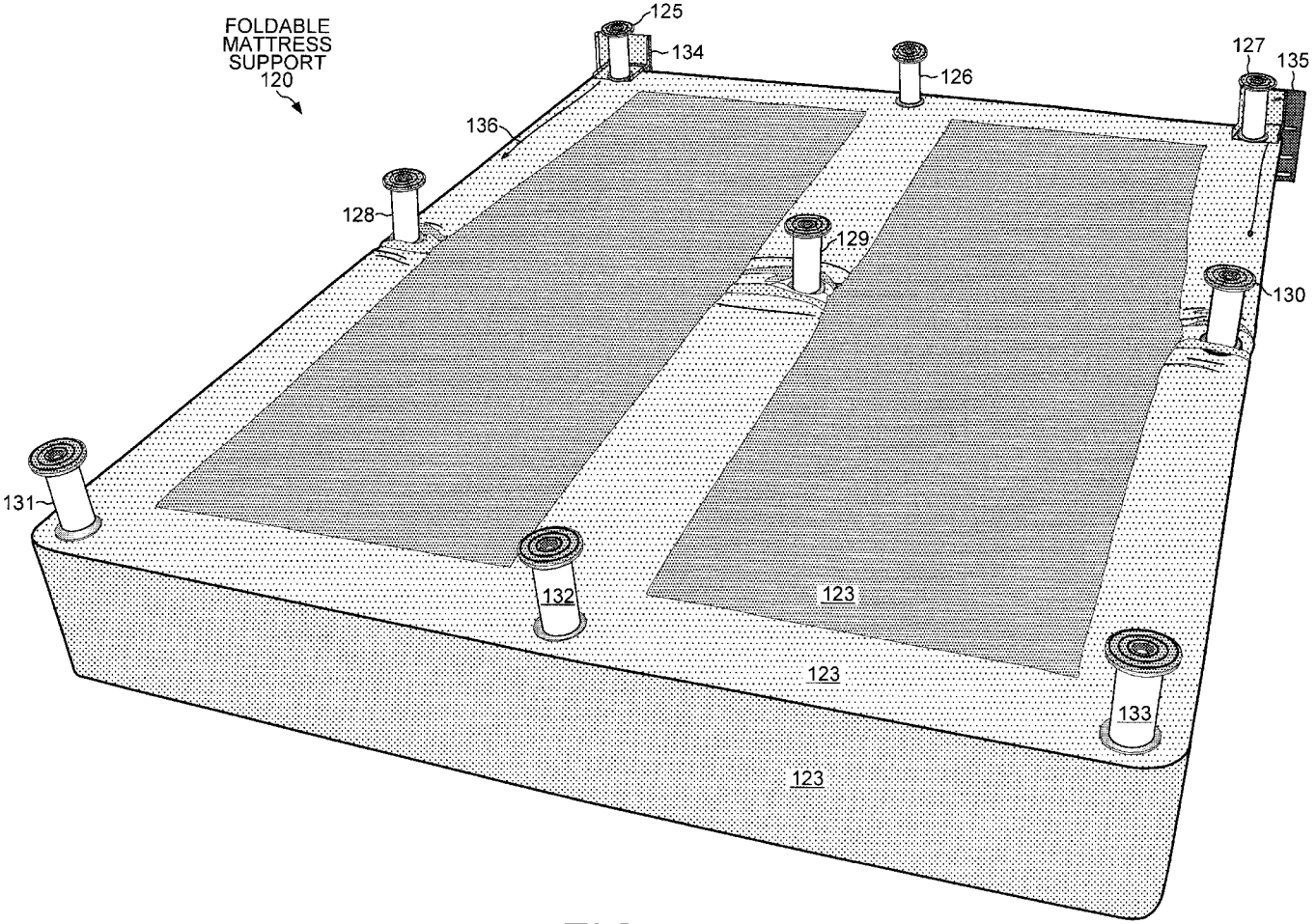
FIG. 14 shows the mattress support of FIG. 13 flipped upside down to show nine legs attached to the bottom side of the support.

FIG. 14 shows mattress support 120 of FIG. 13 flipped upside down to show the bottom side of the support on which the nine legs 125-133 are attached. The legs are attached after mattress support 120 has been completely unfolded. A bolt on each leg fits through a small slit in fabric covering 121 and screws into a threaded hole in the metal frame. FIG. 14 also shows the bulging area on fabric covering 123 where the fabric has been wrinkled by being compressed between head section 121 and foot section 122 while mattress support 120 was sitting in a packing box. Fabric covering 123 can be opened using a zipper 136 in order to remove the covering from the metal frame beneath. Thus, fabric covering 123 can be removed, washed in a washing machine, and then placed back over the metal frame.

Figure 15:
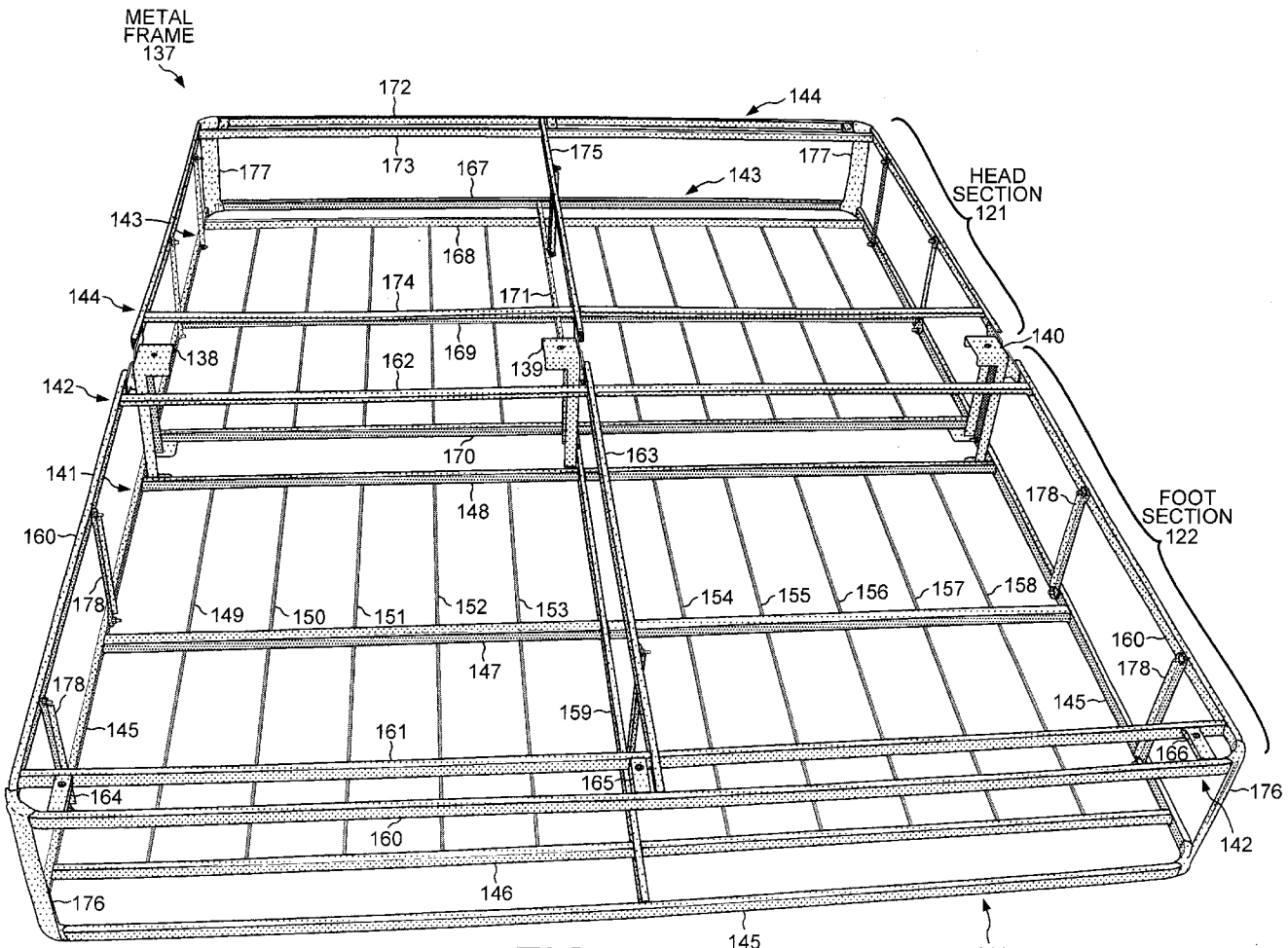
FIG. 15 is a perspective view of a metal frame of the upside down foldable mattress support of FIG. 14 after the fabric covering has been removed.

FIG. 15 shows the metal frame 137 of mattress support 120 of FIGS. 13-14 with fabric covering 123 removed. Metal frame 137 is shown upside down in a completely unfolded state. Mattress support 120 supports a queen size mattress, so metal frame 137 has three center hinges instead of just the two hinges of metal frame 24 of FIG. 3. Head section 121 and foot section 122 have been unfolded at the three hinges 138-140. Head section 121 includes a first upper frame 141 and a first lower frame 142. Foot section 122 includes a second upper frame 143 and a second lower frame 144. First upper frame 141 includes an upper peripheral bar 145, three upper cross bars 146-148 and ten metal rods 149-158. Upper peripheral bar 145 and the three upper cross bars 146-148 are hollow and have a rectangular cross section. Metal rods 149-158 are welded over the top (underneath in the view of FIG. 15) of upper cross bars 146-148. Metal rods 149-158 have a solid, circular cross section. First upper frame 141 also includes an upper central bar 159 connecting upper peripheral bar 145 to hinge 139. Upper central bar 159 separates each of upper cross bars 146-148 into right and left halves.

First lower frame 142 includes a lower peripheral bar 160 and two lower cross bar 161-162. A lower central bar 163 connects lower peripheral bar 160 to hinge 139. Lower central bar 163 separates each of lower cross bars 161-162 into right and left halves. Three foot support bars 164-166 are welded between lower peripheral bar 160 and lower cross bar 161. Each of foot support bars 164-166 has a threaded hole into which a bolt on legs 131-133 screws. Each of hinges 138-140 also has a threaded hole into which a bolt on legs 128-130 screws.

Second upper frame 143 includes an upper peripheral bar 167, three upper cross bar 168-170 and ten metal rods attached to the top (underneath in the view of FIG. 15) of upper cross bars 168-170. Second upper frame 143 also includes an upper central bar 171 connecting upper peripheral bar 167 to hinge 139. Upper central bar 171 separates each of upper cross bars 168-170 into right and left halves. Second lower frame 144 includes a lower peripheral bar 172 and two lower cross bar 173-174. A lower central bar 175 connects lower peripheral bar 172 to hinge 139. Lower central bar 175 separates each of lower cross bars 173-174 into right and left halves. Three foot support bars are welded between lower peripheral bar 172 and lower cross bar 173 and support legs 125-127.

Each of hinges 138-140 includes a vertical plate and a base plate. The threaded holes into which the bolts on legs 128-130 screw are located in the center of the base plates. Foldable mattress support 120 is delivered to the retail store folded with fabric covering 123 already encasing metal frame 137. After mattress support 120 is removed from the packing box and completely unfolded, the bolts on legs 128-130 pass through slits in fabric covering 123 and screw into the threaded holes in the base plates of hinges 138-140.

Upper peripheral bar 145 of first upper frame 141 is pivotally attached to the vertical plates of hinges 138 and 140 and pivots about a first axis. Upper central bar 159 of first upper frame 141 is pivotally attached to the vertical plate of hinge 139 and also pivots about the first axis. Upper peripheral bar 167 of second upper frame 143 is pivotally attached to the vertical plates of hinges 138 and 140 and pivots about a second axis. Upper central bar 171 of second upper frame 143 is pivotally attached to the vertical plate of hinge 139 and also pivots about the second axis. Lower peripheral bar 160 of first lower frame 142 is pivotally attached to the vertical plates of hinges 138 and 140 and pivots about a third axis. Lower central bar 163 of first lower frame 142 is pivotally attached to the vertical plate of hinge 139 and also pivots about the third axis. Lower peripheral bar 172 of second lower frame 144 is pivotally attached to the vertical plates of hinges 138 and 140 and pivots about a fourth axis. Lower central bar 175 of second lower frame 144 is pivotally attached to the vertical plate of hinge 139 and also pivots about the fourth axis. The first axis, the second axis, the third axis and the fourth axis are all orthogonal to the vertical plates of hinges 138-140, which are all parallel to each other. The third axis is spaced farther apart from the fourth axis than the first axis is spaced apart from the second axis. This permits the four frames 141-144 to fold up parallel to each other when mattress support 120 is completely folded.

Elastic straps 176 are bound from the distal corners of upper peripheral bar 145 to the distal corners of lower peripheral bar 160. Likewise, elastic straps 177 are bound from the distal corners of upper peripheral bar 167 to the distal corners of lower peripheral bar 172. Upper peripheral bar 145 is pivotally attached to lower peripheral bar 160 by four bent metal side bars 178. Each of side bars 178 has a perpendicular reinforcing flange. Four side bars also pivotally attach upper peripheral bar 167 to lower peripheral bar 172. The side bars provide structural support to hold up first upper frame 141 and second upper frame 143 under the weight of a mattress resting on foldable mattress support 120. Elastic straps 176-177 hold out fabric covering 123 at the corners of foldable mattress support 120 to maintain the appearance of a box spring.

Figure 16:
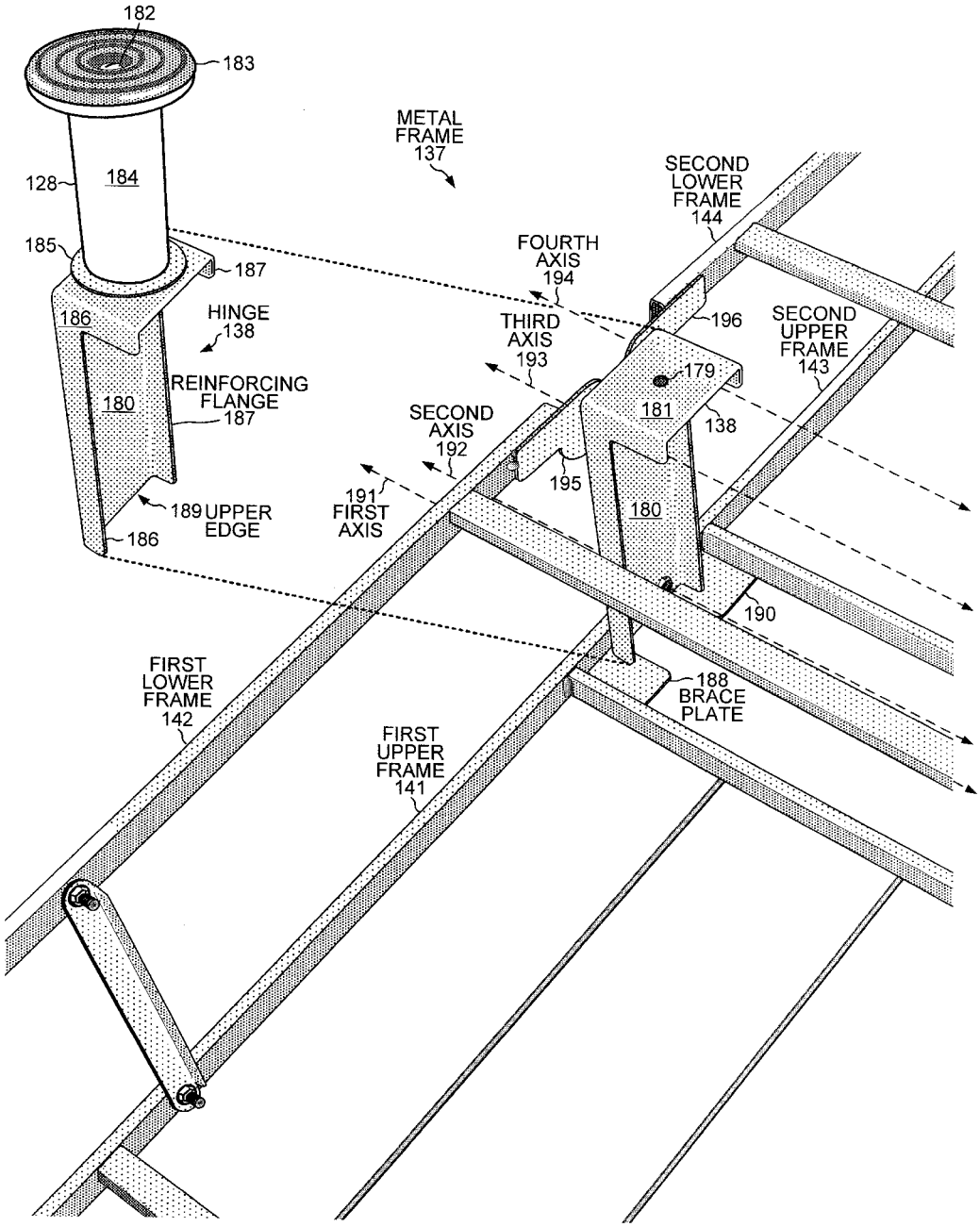
FIG. 16 is a more detailed view of the metal frame of FIG. 15 around a side hinge.

FIG. 16 shows the area of metal frame 137 around hinge 138 in more detail. Metal frame 137 is oriented upside down in both FIGS. 15 and 16 to show the threaded holes 179 where the legs screw into the hinges. Hinge 138 includes a vertical plate 180 and a base plate 181. The threaded hole 179 into which the bolt on leg 128 screws is located in the center base plate 181. Hinge 138 is shown separately at the left of FIG. 16 with leg 128 attached. A bolt 182 passes through a plastic floor disk 183, a metal cylinder 184 and a large washer 185 and screws into threaded hole 179 in order to secure leg 128 to metal frame 137. Threaded hole 179 is made by welding a threaded nut to the opposite side of base plate 181. Leg 128 attaches to mattress support 120 on the outside of fabric covering 123. Thus, leg 128 is attached to base plate 181 by bolt 182 that passes through a slit in fabric covering 123.

Hinge 138 also includes reinforcing flanges 186-187 that are perpendicular to vertical plate 180. When foldable mattress support 120 is completely unfolded, a brace plate 188 on first upper frame 141 rests on reinforcing flange 186 and on an upper edge 189 of vertical plate 180 and prevents first upper frame 141 from rotating lower than parallel to upper edge 189 of vertical plate 180. Similarly, a brace plate 190 on second upper frame 143 rests on reinforcing flange 187 and on upper edge 189 of vertical plate 180 and prevents second upper frame 143 from rotating lower than parallel to upper edge 189 of vertical plate 180.

First upper frame 141 rotates about first axis 191, which is at the center of a bolt that passes through upper peripheral bar 145 and vertical plate 180. Second upper frame 143 rotates about first axis 192, which is at the center of a bolt that passes through upper peripheral bar 167 and vertical plate 180. First lower frame 142 rotates about a third axis 193, and second lower frame 144 rotates about a fourth axis 194. Third axis 193 is at the center of a bolt that passes through vertical plate 180 and an offset circular extension 195 of lower peripheral bar 160. Thus, third axis 193 is somewhat higher (lower in the upside down orientation of FIG. 16) than the middle line of lower peripheral bar 160. Fourth axis 194 is at the center of a bolt that passes through vertical plate 180 and an offset circular extension 196 of lower peripheral bar 172. Each of first axis 191, second axis 192, third axis 193 and fourth axis 194 is orthogonal to vertical plate 180. Third axis 193 is spaced farther apart from fourth axis 194 than first axis 191 is spaced apart from second axis 192.

Figure 17:
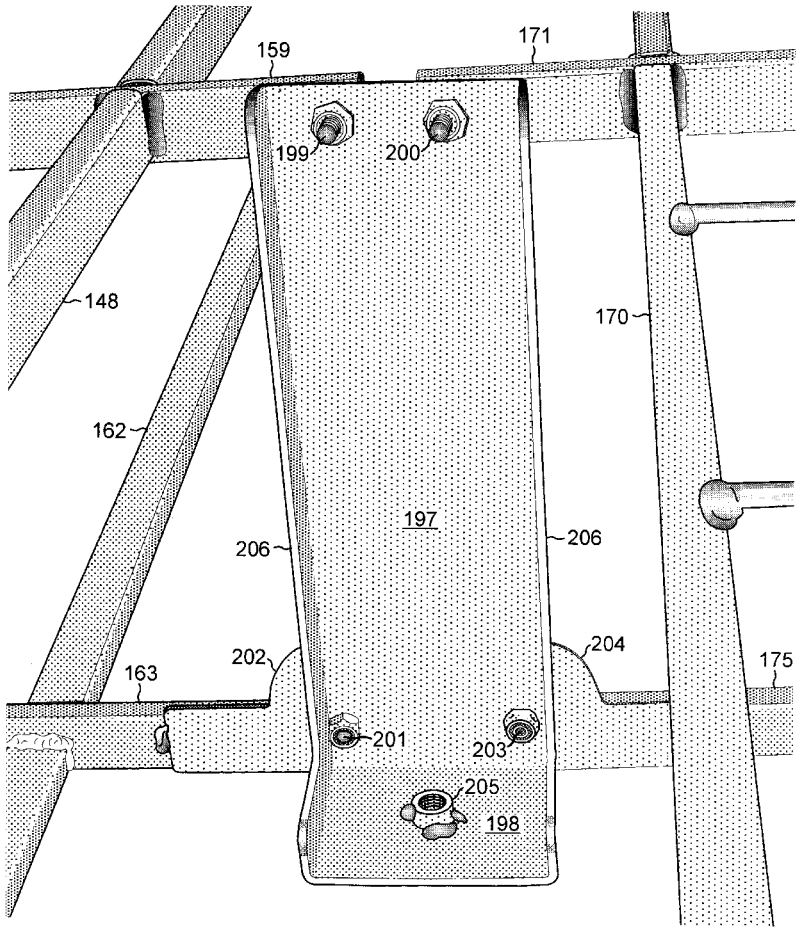
FIG. 17 is a more detailed view of the metal frame of FIG. 15 around a middle hinge.

FIG. 17 shows middle hinge 139 in more detail. Middle hinge 139 includes a vertical plate 197 and a base plate 198. Vertical plate 197 is oriented parallel to vertical plate 180 of hinge 138. Thus, each of the axes 191-194 is also orthogonal to vertical plate 180. First axis 191 passes through the center of a bolt 199 that pivotally attaches upper central bar 159 to vertical plate 197. Second axis 192 passes through the center of a bolt 200 that pivotally attaches upper central bar 171 to vertical plate 197. Third axis 193 passes through the center of a bolt 201 that pivotally attaches an offset circular extension 202 of lower central bar 163 to vertical plate 197. Fourth axis 194 passes through the center of a bolt 203 that pivotally attaches an offset circular extension 204 of lower central bar 175 to vertical plate 197. FIG. 17 also shows the backside of threaded hole 179 in base plate 198 that is made by welding a threaded nut 205 to the base plate above a drilled hole. There are not brace plates attached to first upper frame 141 or second upper frame 143 above the upper edge of vertical plate 197 of middle hinge 139. Middle hinge 139 also has reinforcing flanges 206.

Figure 18:
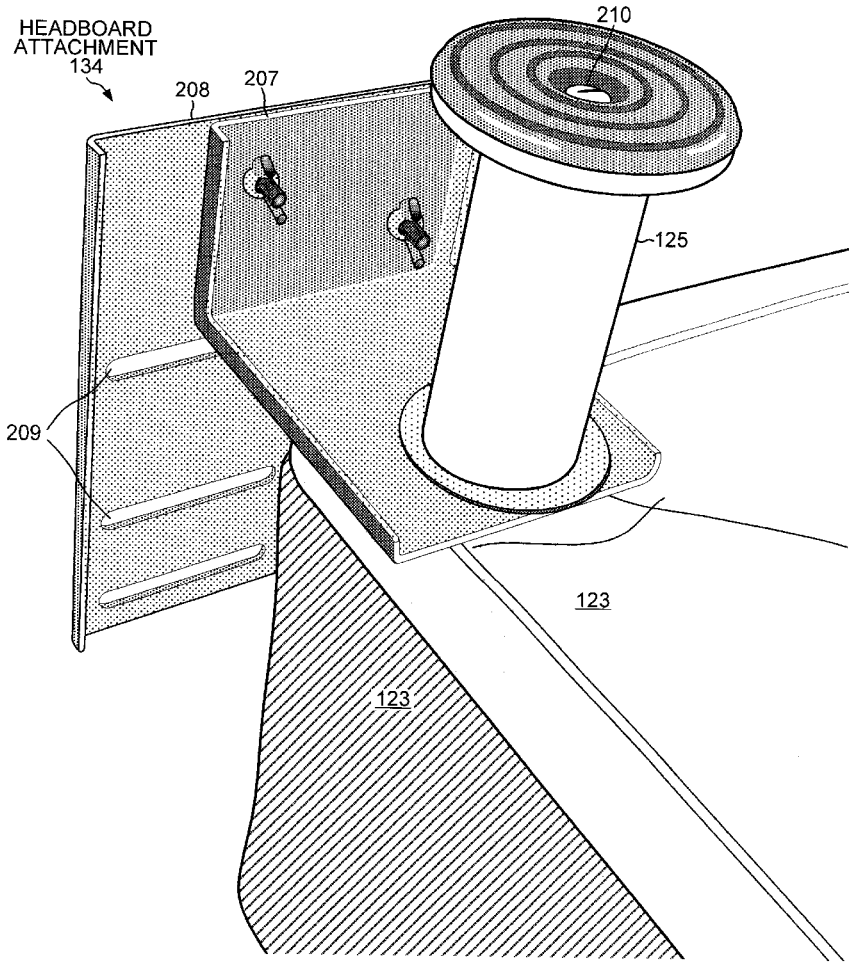
FIG. 18 is a more detailed view of a corner leg and a headboard attachment of FIG. 14.

FIG. 18 shows headboard attachment 134 and leg 125 in more detail. Headboard attachment 134 includes a bent member 207 that is screwed by wing nuts to a headboard plate 208. Headboard plate 208 includes slots 209 into which tongues of a headboard insert to attach the headboard. Headboard attachment 134 attaches to mattress support 120 between metal frame 137 and leg 125. A bolt 210 attaches leg 125 to a foot support bar that is welded between lower peripheral bar 172 and lower cross bar 173 of metal frame 137. Bolt 210 passes through a hole in bent member 207 and secures headboard attachment 134 between leg 125 and metal frame 137. Headboard attachment 134 attaches to mattress support 120 on the outside of fabric covering 123.

Figure 19:
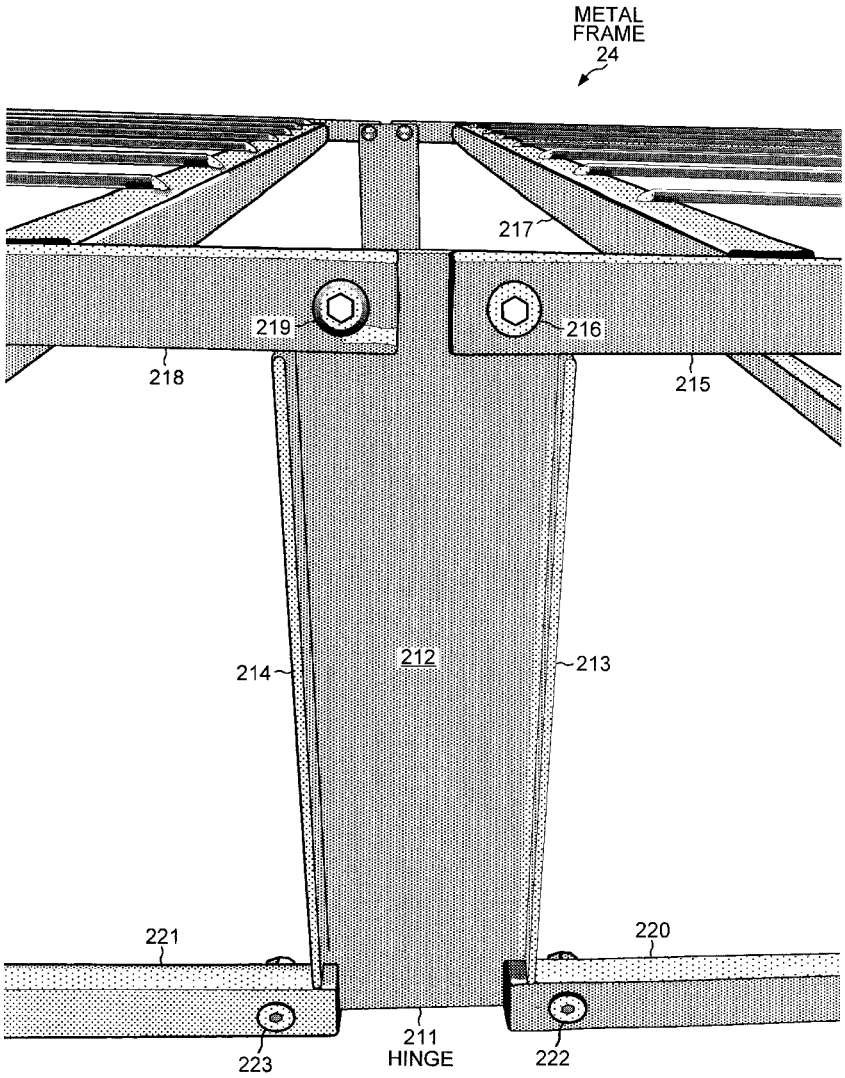
FIG. 19 is a perspective view of the outside of a central plate of another hinge that connects the upper and lower bars of a foldable mattress support.

FIG. 19 shows a modified design for a hinge 211 that can be used in the foldable mattress supports described above, such as in place of first hinge 53 of FIG. 8. Hinge 211 is shown in FIG. 19 in the unfolded state of metal frame 24. Hinge 211 is a piece of sheet metal that has been bent in a different manner than first hinge 53. Hinge 211 has a central plate 212 and two angled flanges (perpendicular wings) 213-214. Hinge 211 allows metal frame 24 to be manufactured more cheaply because brace plates 64, 66 and perpendicular extensions 72-73 of metal frame 24 are no longer needed. For example, brace plate 66 of first hinge 53 contacts the upper edge of first plate 59 and one of the perpendicular wings and prevents upper peripheral bar 42 from rotating down past a horizontal orientation. For hinge 211, however, upper perpendicular bar 215 is braced by the upper edge of angled flange 213 because the flange is bent outwards instead of inwards. Upper peripheral bar 215 is prevented by the upper edge of angled flange 213 from rotating about bolt 216 down past a horizontal orientation. No brace plate need be welded at the corner between upper perpendicular bar 215 and upper cross bar 217. Similarly, upper peripheral bar 218 is prevented by the upper edge of angled flange 214 from rotating about bolt 219 down past a horizontal orientation. The angled flanges 213-214 also prevent lower peripheral bars 220-221 from rotating down past a horizontal orientation. For example, lower peripheral bar 220 is prevented by the lower edge of angled flange 213 from rotating about bolt 222 down past a horizontal orientation.

The short perpendicular extensions 72-73 that are used with first hinge 53 are also no longer necessary with hinge 211. The added length of the perpendicular extensions 72-73 allows the widths of upper peripheral bars 31 and 42 to fit between lower peripheral bars 40 and 51 when the upper and lower frames 27-30 are folded up in the completely collapsed (folded) state. Sufficient distance is achieved between fourth axis 58 (bolt 222) and third axis 57 (bolt 223) by placing the holes for bolts 222-223 at the edges of the bottom of the sheet metal that has not been bent into angled flanges 213-214. Thus, there is sufficient distance between the third and fourth axes 57-58 to allow the widths of upper peripheral bars 215 and 218 to fit between lower peripheral bars 220-221 when the upper and lower frames of metal frame 24 are folded up in the completely collapsed state.

Figure 20:
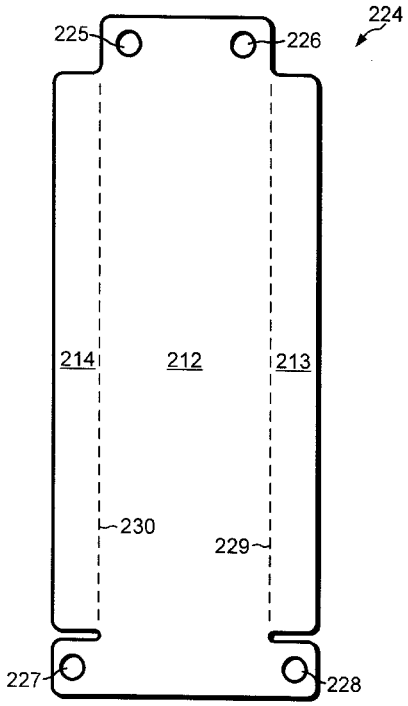
FIG. 20 is a schematic diagram of a template of sheet metal used to make the hinge of FIG. 19.

FIG. 20 shows a template 224 of the sheet metal used to make hinge 211. Bolt holes 225-228 are drilled at the locations of the axes 55-58, respectively. Angled flanges 213-214 are made by bending the metal by ninety degrees at creases along the dashed lines in FIG. 20. Angled flange 213 is bent from central plate 212 at a first crease 229, and angled flange 214 is bent from central plate 212 at a second crease 230. First crease 229 is parallel to second crease 230.

Figure 21:
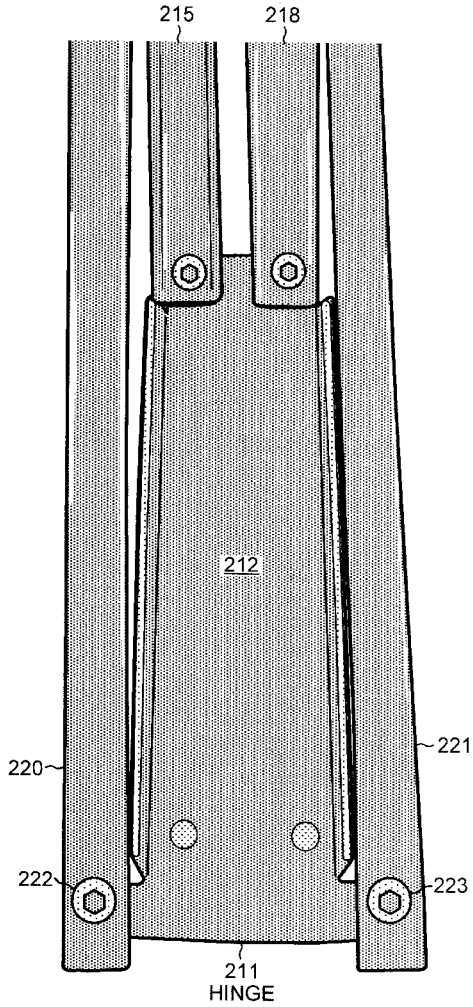
FIG. 21 is a perspective view of the inside surface of the central plate of the hinge of FIG. 19.

FIG. 21 shows the inside surface of central plate 212 of hinge 211 in the folded state. Lower peripheral bars 220-221 come in contact with the longer surfaces of angled flanges 213-214 when metal frame 24 is folded because the flanges are bent towards the side of central plate 212 over which bars rotate.

Figure 22:
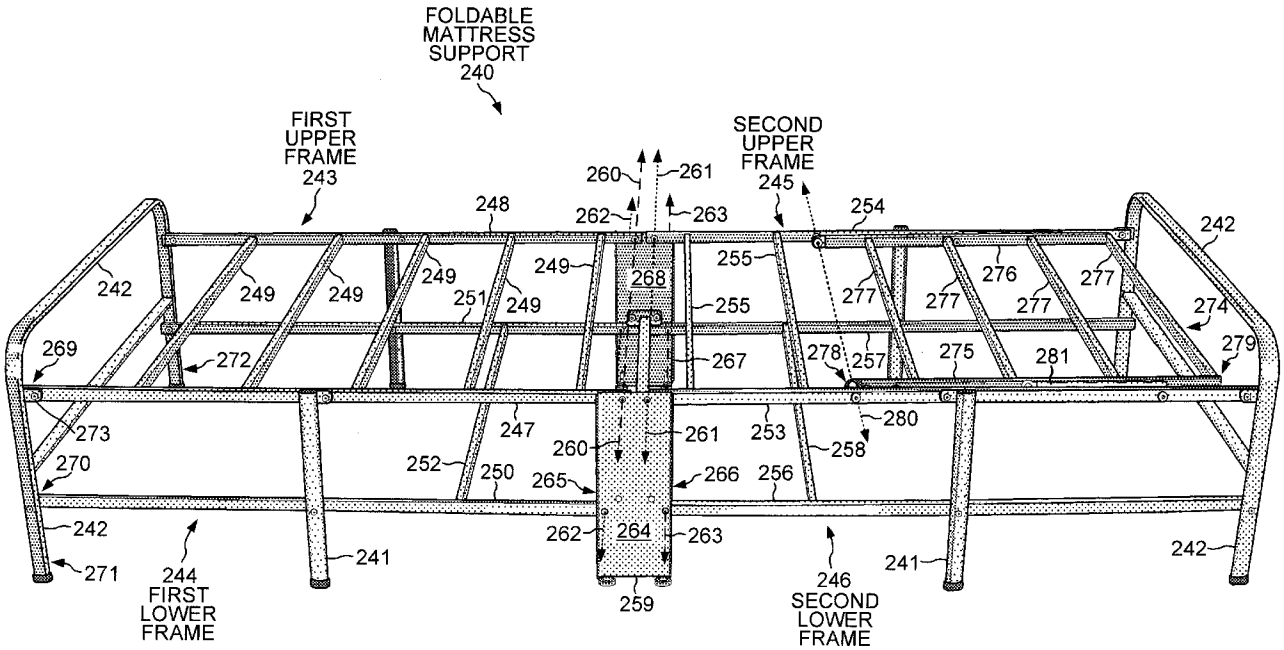
FIG. 22 is a perspective view of an unfolded foldable mattress support in which legs are incorporated into the side bars and end bars.

FIG. 22 shows another embodiment of a foldable mattress support 240 in which legs are incorporated into the side bars 241 and end bars 242. Mattress support 240 can be used without a fabric covering. Whereas foldable mattress support 20 of FIG. 2 has the appearance of a conventional box spring and can be placed on a conventional bed frame of L-shaped side rails, mattress support 240 rests on its own legs. Foldable mattress support 240 easily folds up and can stand on its own, for example in a storage closet. Metal frame 240 is shown in FIG. 22 in a completely unfolded state.

Metal frame 240 has a first upper frame 243, a first lower frame 244, a second upper frame 245 and a second lower frame 246. First upper frame 243 includes a first upper bar 247, another upper bar 248 and cross bars 249. First lower frame 244 includes a first lower bar 250, another lower bar 251 and a cross bar 252. Second upper frame 245 includes a second upper bar 253, another upper bar 254 and cross bars 255. Second lower frame 246 includes a second lower bar 256, another lower bar 257 and a cross bar 258. In one embodiment, the upper and lower bars 247, 250, 253 and 256 and the cross bars 249, 252, 255 and 258 are hollow metal and have a rectangular cross section. The hollow, rectangular metal bars provide stronger structures than would solid bars of the same weight of metal.

First upper bar 247 of first upper frame 243 is pivotally attached to a first hinge 259 such that first upper bar 247 pivots about a first axis 260. Second upper bar 253 of second upper frame 245 is pivotally attached to first hinge 259 and pivots about a second axis 261. First lower bar 250 of first lower frame 244 is pivotally attached to first hinge 259 such that first lower bar 250 pivots about a third axis 262. Second lower bar 256 of second lower frame 246 is pivotally attached to first hinge 259 such that second lower bar 256 pivots about a fourth axis 263. First hinge 259 includes a central plate 264, a first angled flange 265 and a second angled flange 266. Each of first axis 260, second axis 261, third axis 262 and fourth axis 263 is orthogonal to central plate 264. In both the folded and unfolded state of metal frame 240, central plate 264 is oriented vertically. FIG. 22 shows that third axis 262 is spaced farther apart from fourth axis 263 than first axis 260 is spaced apart from second axis 261. Metal frame 240 also includes a second hinge 267 that includes a second vertical plate 268 oriented parallel to central plate 264. Thus, each of the axes 260-263 is also orthogonal to second plate 268.

First upper bar 247 has a first distal end 269 away from vertical plate 264, and first lower bar 250 has a second distal end 270 away from vertical plate 264. Both first distal end 269 and second distal end 270 are pivotally attached to an end bar 242. End bar 242 is bent such that it forms a first leg 271 supporting first lower bar 250 as well as a second leg 272 supporting lower bar 251. The middle of bent end bar 242 forms a railing that holds a mattress in place on when metal frame 240 is completely unfolded. First distal end 269 is attached to end bar 242 through a hinge extension 273 on end bar 242. Hinge extension 273 allows end bar 242 to be oriented vertically when metal frame 240 is completely folded and first upper bar 247 and first lower bar 250 become adjacent to one another. Another end bar 242 similarly pivotally attaches second upper bar 253 to second lower bar 256.

In addition, first upper bar 247 is pivotally attached to first lower bar 250 by a side bar 241. Another side bar 241 also pivotally attaches second upper bar 253 to second lower bar 256. Side bars 241 also include hinge extensions that allow the end bars to be oriented vertically when metal frame 240 is completely folded and first upper bar 247 and first lower bar 250 become adjacent to one another. Side bars 241 provide structural support to hold up first upper frame 243 and second upper frame 245 under the weight of a mattress resting on foldable mattress support 240.

Foldable mattress support 240 also includes an adjustable inner frame 274 that can be manually adjusted to raise the shoulder and head portion of a mattress placed on support 240. Frame 274 includes a third upper bar 275, another upper bar 276 and cross bars 277. Third upper bar 275 has an inner end 278 and an outer end 279. Third upper bar 275 pivots at inner end 278 about a fifth axis 280 that passes through second upper bar 253. First distal end 269 is farther from fifth axis 280 than outer end 279 is from fifth axis 280. Adjustable inner frame 274 can be elevated at outer end 279 when foldable mattress support 240 is completely unfolded. A ratchet support 281 maintains the elevated orientation of frame 274 in the position manually set by the user of mattress support 240. Ratchet support 281 is pivotally attached to both third upper bar 275 and second upper bar 253. Although FIG. 22 shows adjustable inner frame 274 pivotally attached to second upper bar 253, frame 274 can also be attached analogously to first upper bar 247 in a mirror-image manner.

Figure 23:
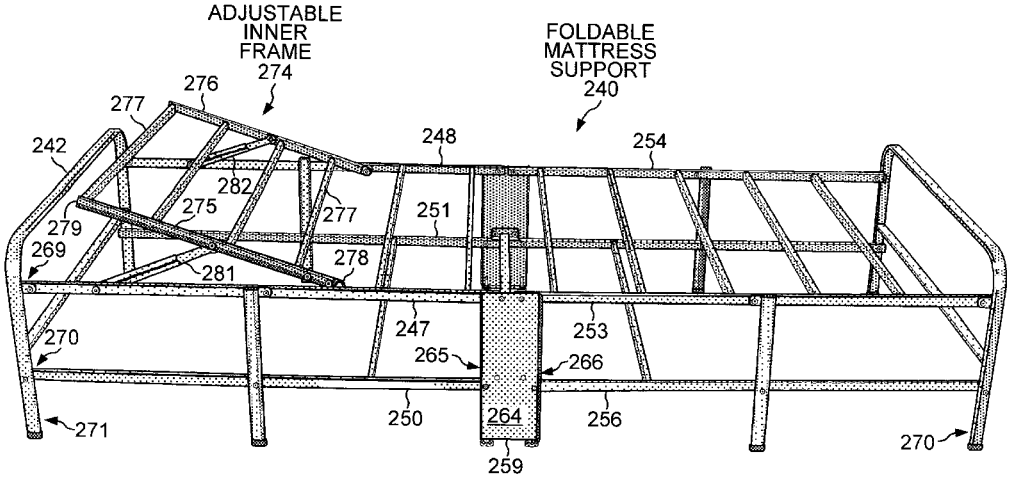
FIG. 23 is a perspective view of an unfolded mattress support with an elevated adjustable inner frame.

FIG. 23 shows foldable mattress support 240 with adjustable inner frame 274 elevated. Inner frame 274 is attached on the opposite side of support 240 in FIG. 23 than as shown in FIG. 22. The fifth axis 280 about which inner end 278 of third upper bar 275 pivots passes through first upper bar 247. First distal end 269 of first upper bar 247 is farther from fifth axis 280 than outer end 279 of third upper bar 275 is from fifth axis 280. In addition to ratchet support 281, which is pivotally attached to both first upper bar 247 and third upper bar 275, inner frame 274 also includes a second ratchet support 282 that is pivotally attached to both upper bar 248 and upper bar 276.

A user of mattress support 240 can raise adjustable inner frame 274 by pulling up on the cross bar 277 that is attached at the outer end 279 of upper bar 275. The ratchets 281-282 hold inner frame 274 at the highest position to which frame 274 has been lifted. To lower frame 274, the user first elevates frame 274 to the maximum extension of the ratchet supports 281-282, which then release the ratchet function and allow inner frame 274 to be lowered in between first upper bar 247 and the opposite upper bar 248.

Figure 24:
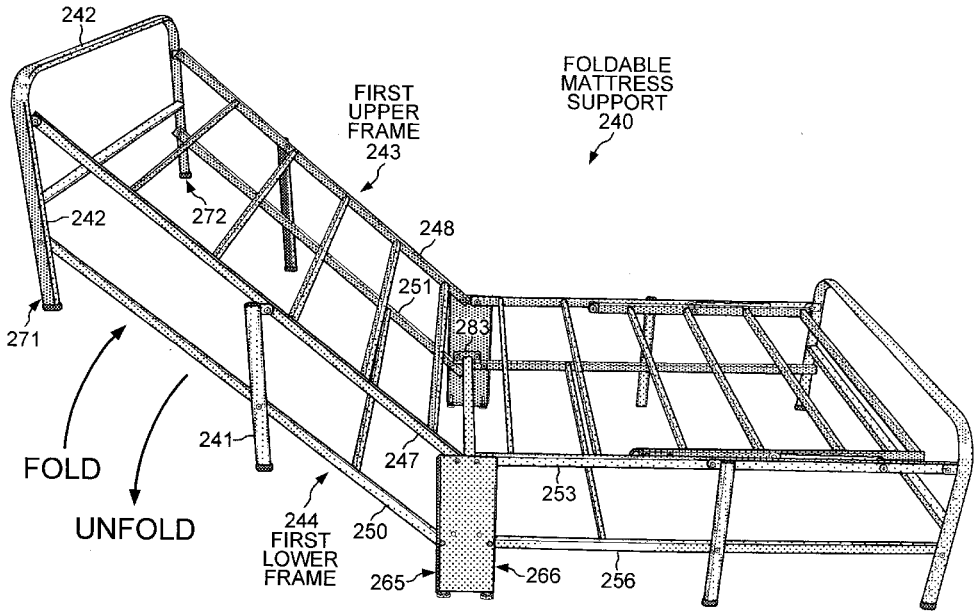
FIG. 24 is a perspective view of the foldable mattress support of FIG. 22 in the process of being folded.

FIG. 24 shows foldable mattress support 240 in the process of being folded closed or collapsed. For example, FIG. 24 depicts foldable mattress support 240 prior to the support being placed in a packing box for shipment. First upper frame 247 remains substantially parallel to first lower frame 250 as mattress support 240 is folded. When mattress support 240 is completely collapsed or folded, the side bars 241 and the legs 271-272 of end bar 242 are substantially parallel to the angled flanges 265-266 on the sides of central plate 264. As mattress support 240 is unfolded, the side bars 241 and the legs 271-272 remain substantially parallel to the angled flanges 265-266.

When viewing FIG. 24 from the perspective of unfolding mattress support 240, first upper frame 243 and first lower frame 244 are being unfolded but are not yet supported by legs 271-272 on end bar 242 and by the legs on side bars 241. When mattress support 240 is unfolded, braces that are attached to each central plate prevent the lower bars from rotating past horizontal. FIG. 24 shows a brace 283 that is attached to the inside of central plate 268. Brace 283 prevents lower bar 251 from pivoting past horizontal about third axis 262 when foldable mattress support 240 is completely unfolded.

Figure 25:
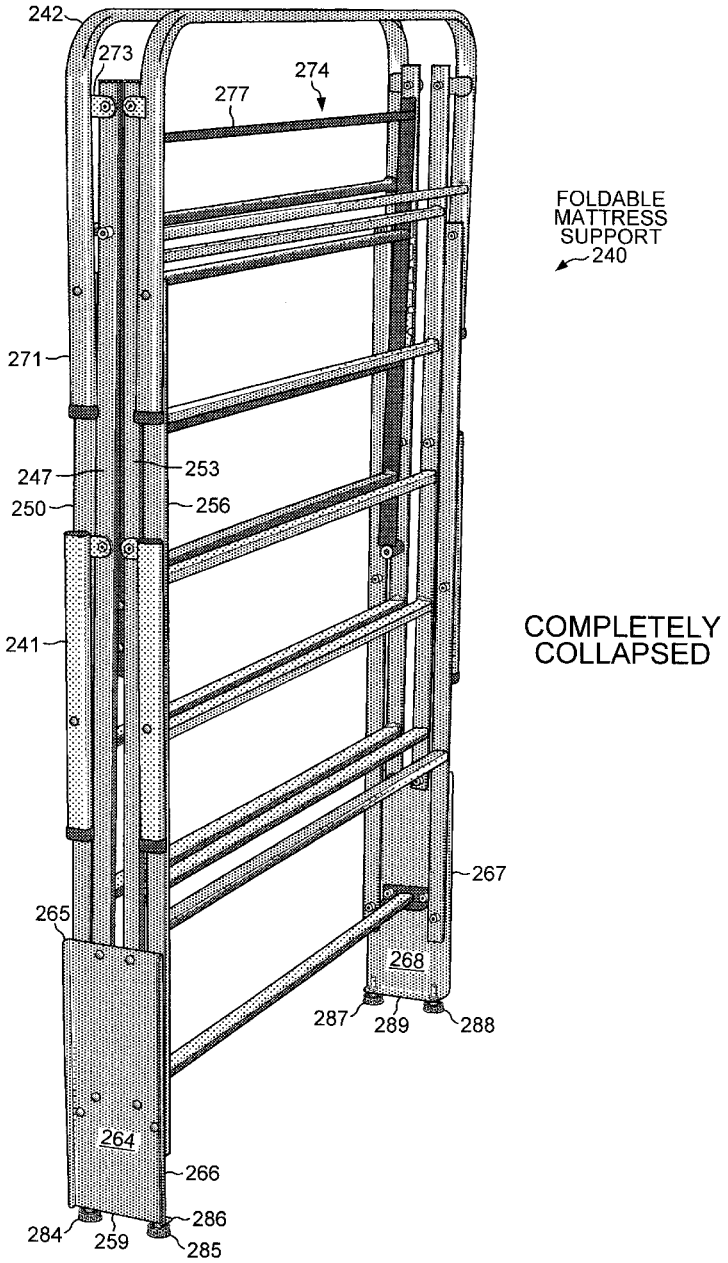
FIG. 25 is a perspective view of the foldable mattress support of FIG. 23 in the completely collapsed or folded state.

FIG. 25 shows mattress support 240 of FIG. 23 in a completely collapsed or folded state. The hinge extensions 273 on end bars 242 allow the legs 271-272 to be oriented vertically when metal frame 240 is completely folded and first upper bar 247 is folded adjacent to second upper bar 253. The hinge extensions 273 on side bars 241 also permit the side bars to be oriented vertically when mattress support 240 is completely folded. FIG. 25 also shows foot pads 284-285 attached to a bottom flange 286 of first hinge 259. Similarly, foot pads 287-288 are attached to a bottom flange 289 of second hinge 267. Foldable mattress support 240 is capable of resting only on foot pads 284-285 and 287-288 when mattress support 240 is completely folded.

Figure 26:
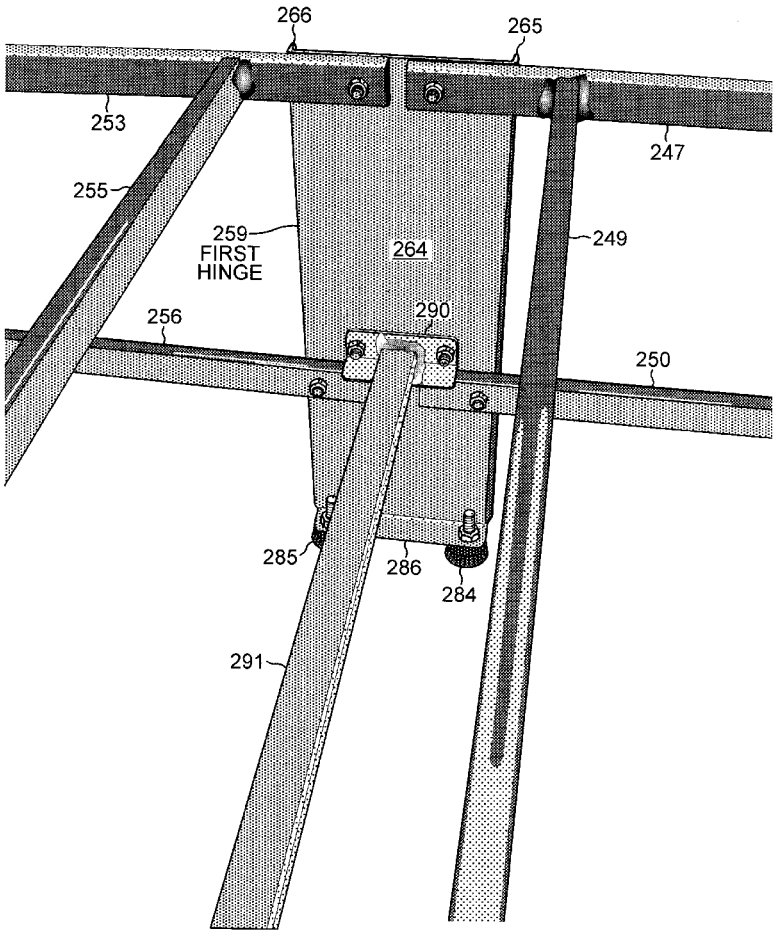
FIG. 26 is a more detailed perspective view of the back side of a hinge of the foldable mattress support of FIG. 22.

FIG. 26 is a more detailed view of first hinge 259 from the back side of the view shown in FIG. 22. FIG. 26 shows bottom flange 286 to which foot pads 284-285 are attached. A brace 290 is attached to the inside of central plate 264. Brace 290 prevents both first lower bar 250 and second lower bar 256 from pivoting about axes 262-263 past a horizontal orientation when foldable mattress support 240 is completely unfolded. In FIG. 26, the tops of both first lower bar 250 and second lower bar 256 are pressing against the bottom of brace 290. A middle bar 291 is welded to both brace 290 and brace 283 and thereby connects first hinge 259 to second hinge 267.

Figure 27:
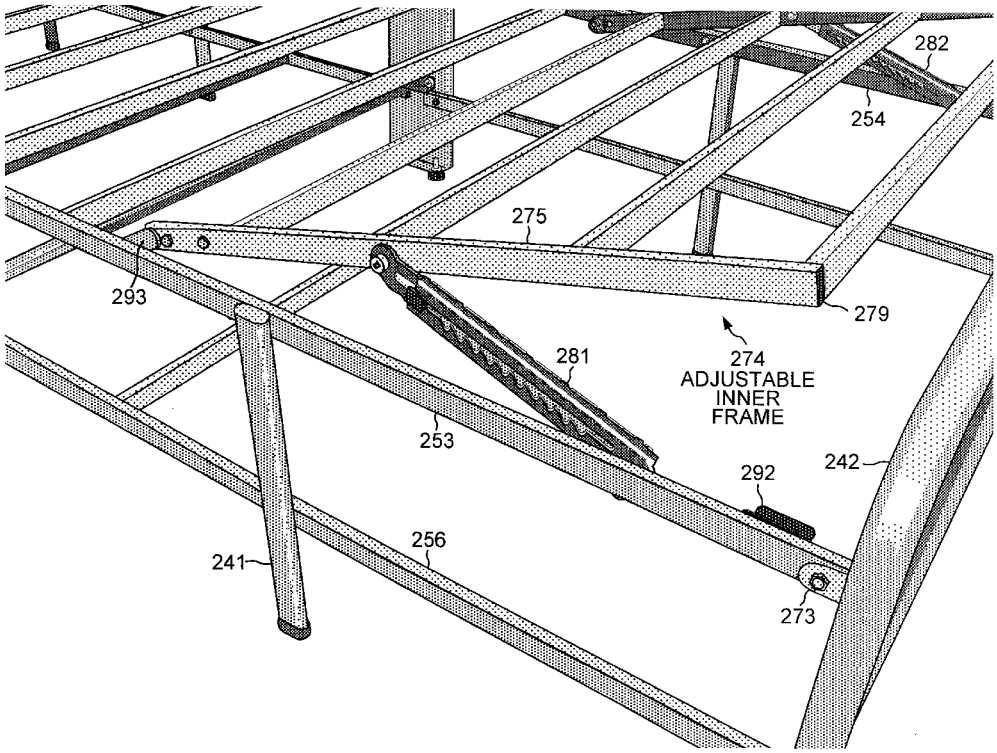
FIG. 27 is a more detailed perspective view of the adjustable inner frame and ratchet supports of the foldable mattress support of FIG. 22.

FIG. 27 shows adjustable inner frame 274 and ratchet supports 281-282 in more detail. Ratchet supports 281-282 hold inner frame 274 in an elevated orientation that inclines the head and shoulder portion of a mattress resting on mattress support 240. The inclined mattress is then in a more comfortable position for reading or watching television. When adjustable inner frame 274 is completely lowered it rests on a support 292 attached to second upper bar 253 and on another support attached to upper bar 254. Ratchet support 281 is pivotally attached to both second upper bar 253 and third upper bar 275 between these two bars. In order to provided space for ratchet support 281 between bar 253 and bar 275, inner frame 274 must be narrower than the space between second upper bar 253 and bar 254. A pivot axis extension 293 allows third upper bar 275 to be pivotally attached to second upper bar 253 while still allowing space for ratchet support 281 between the two bars.

Although certain specific embodiments are described above for instructional purposes, the teachings of this patent document have general applicability and are not limited to the specific embodiments described above. Although the peripheral bars and cross bars are described above as being hollow and having rectangular cross sections, foldable mattress supports 20, 82 and 120 can also be made using peripheral bars and cross bars having other cross sections. For example, the peripheral bars and cross bars can have a solid, circular cross section. Accordingly, various modifications, adaptations, and combinations of various features of the described embodiments can be practiced without departing from the scope of the invention as set forth in the claims.

What is claimed is:

1. A foldable mattress support comprising:

a first upper bar;

a first lower bar;

a second upper bar;

a second lower bar;

a vertical plate, wherein the first upper bar is pivotally attached to the vertical plate and pivots about a first axis, wherein the first upper bar has a first distal end away from the vertical plate, wherein the second upper bar is pivotally attached to the vertical plate and pivots about a second axis, wherein the first lower bar has a second distal end away from the vertical plate, wherein the first lower bar is pivotally attached to the vertical plate and pivots about a third axis, wherein the second lower bar is pivotally attached to the vertical plate and pivots about a fourth axis, wherein each of the first axis, the second axis, the third axis and the fourth axis is orthogonal to the vertical plate, and wherein the third axis is spaced farther apart from the fourth axis than the first axis is spaced apart from the second axis; and an end bar, wherein the first distal end is pivotally attached to the end bar, and wherein the second distal end is pivotally attached to the end bar.

2. The foldable mattress support of claim 1, wherein the end bar has a leg, and wherein the foldable mattress support rests on the leg when the foldable mattress support is completely unfolded.

3. The foldable mattress support of claim 1, wherein the end bar extends above the first upper bar and below the first lower bar when the foldable mattress support is completely unfolded.

4. The foldable mattress support of claim 1, further comprising:

a third upper bar with an inner end and an outer end, wherein the third upper bar pivots at the inner end about a fifth axis, wherein the fifth axis passes through the first upper bar, and wherein the first distal end is farther from the fifth axis than the outer end is from the fifth axis.

5. The foldable mattress support of claim 4, further comprising:

a ratchet support pivotally attached to both the third upper bar and the first upper bar.

6. The foldable mattress support of claim 4, wherein the third upper bar is part of an adjustable inner frame that can be elevated at the outer end when the foldable mattress support is completely unfolded.

7. The foldable mattress support of claim 1, wherein the vertical plate is connected to a bottom flange with foot pads, and wherein the foldable mattress support rests on the foot pads.

8. The foldable mattress support of claim 7, wherein the foldable mattress support rests only on the foot pads when the foldable mattress support is completely folded.

9. The foldable mattress support of claim 1, further comprising:

a brace attached to the vertical plate, wherein the first lower bar is prevented by the brace from further pivoting about the third axis when the foldable mattress support is completely unfolded.

10. A foldable mattress support comprising:

a first upper bar;

a first lower bar;

a second upper bar;

a second lower bar; and a hinge that includes a central plate, a first angled flange and a second angled flange, wherein the first upper bar is pivotally attached to the central plate and pivots about a first axis, wherein the second upper bar is pivotally attached to the central plate and pivots about a second axis, wherein the first lower bar is pivotally attached to the central plate and pivots about a third axis, wherein the second lower bar is pivotally attached to the central plate and pivots about a fourth axis, wherein each of the first axis, the second axis, the third axis and the fourth axis is orthogonal to the central plate, and wherein the third axis is spaced farther apart from the fourth axis than the first axis is spaced apart from the second axis.

11. The foldable mattress support of claim 10, wherein the first angled flange is perpendicular to the central plate, and wherein the first lower bar is prevented by a lower edge of the first angled flange from further pivoting about the third axis when the foldable mattress support is completely unfolded.

12. The foldable mattress support of claim 10, wherein the first angled flange is perpendicular to the central plate, and wherein the first upper bar is prevented by an upper edge of the first angled flange from further pivoting about the first axis when the foldable mattress support is completely unfolded.

13. The foldable mattress support of claim 10, wherein the first upper bar has a first distal end away from the central plate, and wherein the first lower bar has a second distal end away from the central plate, further comprising:

an end bar, wherein the first distal end is pivotally attached to the end bar, and wherein the second distal end is pivotally attached to the end bar.

14. The foldable mattress support of claim 10, wherein the end bar includes a hinge extension, wherein the first distal end is pivotally attached to the hinge extension, and wherein the hinge extension allows the end bar to be oriented parallel to the first lower bar when the first upper bar and the first lower bar are rotated so as to become adjacent to one another.

15. A method of manufacturing a foldable mattress support, comprising:

bending a sheet of metal to form a first angled flange, a second angled flange and a central plate, wherein the first angled flange is bent from the central plate at a first crease, wherein the second angled flange is bent from the central plate at a second crease, and wherein the first crease is parallel to the second crease;

pivotally attaching a first upper bar to the central plate such that the first upper bar pivots about a first axis;

pivotally attaching a second upper bar to the central plate such that the second upper bar pivots about a second axis;

pivotally attaching a first lower bar to the central plate such that the first lower bar pivots about a third axis; and pivotally attaching a second lower bar to the central plate such that the second lower bar pivots about a fourth axis, wherein each of the first axis, the second axis, the third axis and the fourth axis is orthogonal to the central plate, and wherein the third axis is spaced farther apart from the fourth axis than the first axis is spaced apart from the second axis.

16. The method of claim 15, further comprising:

pivotally attaching a third upper bar to the first upper bar, wherein the third upper bar has an inner end and an outer end, wherein the third upper bar pivots at the inner end about a fifth axis, and wherein the fifth axis is parallel to the first axis.

17. The method of claim 16, further comprising:

attaching a ratchet support to both the third upper bar and the first upper bar.

18. The method of claim 15, wherein the first upper bar has a first distal end away from the central plate, and wherein the first lower bar has a second distal end away from the central plate, further comprising:

pivotally attaching an end bar to both the first distal end and the second distal end.

19. The method of claim 15, further comprising:

folding the first upper bar and the second upper bar such that the first upper bar is substantially parallel to the second upper bar; and inserting the foldable mattress support into a packing box.

20. The method of claim 15, further comprising:

attaching a brace to the central plate that prevents the first lower bar from pivoting about the third axis past a horizontal orientation.

* * * * *